United States Patent [19]

Yamaguchi et al.

[11] Patent Number: 5,056,401

[45] Date of Patent: Oct. 15, 1991

[54] ELECTRONIC MUSICAL INSTRUMENT HAVING AN AUTOMATIC TONALITY DESIGNATING FUNCTION

[75] Inventors: Yorihisa Yamaguchi, Hamamatsu; Hasegawa Tsutomu, Tokyo, both of Japan

[73] Assignee: Yamaha Corporation, Hamamatsu, Japan

[21] Appl. No.: 383,312

[22] Filed: Jul. 20, 1989

[30] Foreign Application Priority Data

| | | | |
|---|---|---|---|
| Jul. 20, 1988 | [JP] | Japan | 63-180840 |
| Jul. 20, 1988 | [JP] | Japan | 63-180841 |
| Jul. 20, 1988 | [JP] | Japan | 63-180842 |
| Jul. 20, 1988 | [JP] | Japan | 63-180843 |
| Jul. 20, 1988 | [JP] | Japan | 63-180844 |
| Jul. 20, 1988 | [JP] | Japan | 63-180845 |

[51] Int. Cl.[5] ..... G10H 1/38; G10H 1/40

[52] U.S. Cl. ..... 84/635; 84/637; 84/DIG. 12; 84/DIG. 22

[58] Field of Search ..... 84/635-638, 84/666-669, 712-717, DIG. 12, DIG. 22, 609-614, 650-652

[56] References Cited

U.S. PATENT DOCUMENTS 4,184,401 1/1980 Hiyoshi, et al. .
4,419,916 12/1983 Aoki .
4,489,636 12/1984 Aoki et al. .

FOREIGN PATENT DOCUMENTS 53-26115 3/1978 Japan .
57-136696 8/1982 Japan .
61-292692 12/1986 Japan .

*Primary Examiner*—Stanley J. Witkowski
*Attorney, Agent, or Firm*—Spensley Horn Jubas & Lubitz

[57] ABSTRACT

An electronic musical instrument provides an automatic tonality designating function capable of automatically designating a desirable tonality based on a chord and a rhythm kind which are respectively designated. The chord is designated by simultaneously depressing plural keyboard keys, while desirable one of plural rhythm kinds which are predetermined in advance is designated by the performer. In addition, a desirable mode can be determined based on the designated chord. Based on the mode, chord and rhythm kind, an automatic accompaniment can be performed. Further, this electronic musical instrument can also provide a chord detecting apparatus capable of automatically detecting a desirable chord based on plural notes (or note names) designated by the performer. In such chord detection, an evasive note is automatically omitted from all notes designated by the performer, so that the desirable chord can be detected with accuracy.

35 Claims, 23 Drawing Sheets

83f:DEPRESSED KEY FLAG TABLE

| CTAD | | | | |
|---|---|---|---|---|
| 0 | 0/1 | 0/1 | | 0/1 |
| 1 | 0/1 | 0/1 | | 0/1 |
| | | | | |
| 7 | 0/1 | 0/1 | | 0/1 |

FIG.2E

83g:CHORD TABLE

| CTAD | | | |
|---|---|---|---|
| 0 | ROOT | TYPE | CTENL |
| 1 | ROOT | TYPE | CTENL |
| | | | |
| 7 | — | — | — |

FIG.2F

83h:BLUES TABLE

| | C | C# | - - - - - - - - - - | B |
|---|---|---|---|---|
| I 7 | 0/1 | 0/1 | | 0/1 |
| I V 7 | 0/1 | 0/1 | | 0/1 |
| V 7 | 0/1 | 0/1 | | 0/1 |
| I m 7 | 0/1 | 0/1 | | 0/1 |
| I V m 7 | 0/1 | 0/1 | | 0/1 |
| V m 7 | 0/1 | 0/1 | | 0/1 |

FIG. 2G

83i:KEY FLAG TABLE

| | C | C# | - - - - - - - - - - - - | B |
|---|---|---|---|---|
| MAJOR KEY | 0 ~ 3 | 0 ~ 3 | | 0 ~ 3 |
| MINOR KEY | 0 ~ 3 | 0 ~ 3 | | 0 ~ 3 |
| BLUES MAJOR KEY | 0 ~ 3 | 0 ~ 3 | | 0 ~ 3 |
| BLUES MINOR KEY | 0 ~ 3 | 0 ~ 3 | | 0 ~ 3 |

FIG. 2H

83j:OTHER REGISTERS

| | |
|---|---|
| PSTF | (PERFORMANCE START FLAG) |
| PSTMF | (PERFORMANCE START MINOR FLAG) |
| BAAD | (BUFFER ADDRESS) |
| CTAD | (CURRENT TABLE ADDRESS) |
| PCDF | (PRIORITY CHORD FLAG) |
| PCCF | (PRIMARY CADENCE COHRD FLAG) |
| DPCHD | (KEY-DEPRESSION CHORD DATA) |
| SUMTENL 1 | (1ST TENTION LEVEL SUM VALUE) |
| SUMTENL 2 | (2ND TENTION LEVEL SUM VALUE) |
| KMKD | (TEMPORARY KEY DATA) |
| MKD | (KEY DATA) |
| MKSF | (KEY SETTING FLAG) |
| SCALE | (MODE DATA) |
| RHY | (RHYTHM KIND DATA) |
| RUN | (RHYTHM RUN FLAG) |
| TCNT | (TEMPO COUNT DATA) |

FIG.2 I

91a:CHORD CONSTITUENT NOTE TABLE

| | CONSTITUENT NOTE | TENTION TONE (TENTION NOTE NUMBER) | | | | |
|---|---|---|---|---|---|---|
| m7th | 1°,3°♭,5°,7°♭ | 9°(2) | 11°(3) | | | |
| m7th(♭5) | 1°,3°♭,5°♭,7°♭ | 9°(2) | 11°(3) | 13°♭(6) | | |
| 7th | 1°,3°,5°,7°♭ | 9°♭(8) | 9°(2) | 13°♭(6) | 13°(5) | |
| ..... | | | | | | |
| Maj | 1°,3°,5°(6°,7°) | 7°(1) | 9°(2) | 11°#(4) | | |
| sus4 | 1°,3#,5°,7° | 9°(2) | 11°(3) | 13°(5) | | |

FIG. 3 A

91b:CHORD TENTION TABLE

| | | | |
|---|---|---|---|
| 1ST GROUP (PRIMARY CHORD) | Ⅰ Maj | (CMaj) | 1 |
| | Ⅱm7th | (Dm7th) | 3 |
| | Ⅲm7th | (Em7th) | 2 |
| | Ⅳ Maj | (FMaj) | 4 |
| | Ⅴ7th | (G7th) | 10 |
| | Ⅵm7th | (Am7th) | 2 |
| | Ⅶm7th(♭5) | [Bm7th(♭5)] | 8 |
| | Ⅴ7th(sus4) | [G7th(sus4)] | 9 |
| 2ND GROUP (RELATED Ⅱ OF SECONDARY DOMINANT) | RⅡ・Ⅴ7th/Ⅱ | (Em7th) | 5 |
| | RⅡ・Ⅴ7th/Ⅲ | (F*m7th) | 4 |
| | ⋮ | ⋮ | ⋮ |
| 3RD GROUP (SECONDARY DOMINANT SUSPENDED 4) | Ⅴ7th(sus4)/Ⅱ | [A7th(sus4)] | 11 |
| | Ⅴ7th(sus4)/Ⅲ | [B7th(sus4)] | 10 |
| | ⋮ | ⋮ | ⋮ |
| 4TH GROUP (SECONDARY DOMINANT) | Ⅴ7th/Ⅱ | (A7th) | 12 |
| | Ⅴ7th/Ⅲ | (B7th) | 11 |
| | ⋮ | ⋮ | ⋮ |
| 5TH GROUP (RELATED Ⅱ OF SUBSTITUTED SECONDARY DOMINANT) | RⅡ・SubⅤ7th/Ⅰ | (Abm7th) | 12 |
| | RⅡ・SubⅤ7th/Ⅱ | (Bbm7th) | 14 |
| | ⋮ | ⋮ | ⋮ |
| 6TH GROUP (SUBSTITUTED SECONDARY DOMINANT SUSPENDED 4) | SubⅤ7th(sus4)/Ⅰ | [Db7th(sus4)] | 18 |
| | SubⅤ7th(sus4)/Ⅱ | [Eb7th(sus4)] | 20 |
| | ⋮ | ⋮ | ⋮ |
| 7TH GROUP (SUBSTITUTED SECONDARY DOMINANT) | SubⅤ7th/Ⅰ | (Db7th) | 19 |
| | SubⅤ7th/Ⅱ | (Eb7th) | 20 |
| | ⋮ | ⋮ | ⋮ |
| | DEGREE-EXPRESSED CHORD NAME (C KEY CHORD NAME) | | CTENL |

FIG. 3 C

91c:PRIMARY/CADENCE CHORD TABLE

| | |
|---|---|
| PRIMARY CHORD | Ⅰm7th, Ⅱ7th - - - - - - - - - - |
| CADENCE CHORD | Ⅱm7th(♭5), Ⅳ7th - - - - - - - - - - |

FIG. 3 D

91c:1ST MODE TABLE

| | |
|---|---|
| Ⅰ Maj | IONIAN |
| Ⅱm7th | DORIAN |
| Ⅲm7th | PHRYGIAN |
| ⋮ | ⋮ |
| 4TH GROUP | MIXOLYDIAN |
| 2ND GROUP | DORIAN |
| ⋮ | ⋮ |

CHORD NAME MODE NAME

FIG. 3 E

91e:2ND MODE TABLE

| | |
|---|---|
| Maj | IONIAN |
| Min | DORIAN |
| ⋮ | ⋮ |

TYPE MODE NAME

FIG. 3 F

ELECTRONIC MUSICAL INSTRUMENT HAVING AN AUTOMATIC TONALITY DESIGNATING FUNCTION

BACKGROUND OF THE INVENTION

1. Field of the Invention

The present invention relates to an electronic musical instrument, and more particularly to an electronic musical instrument having an automatic key designating function by which a desirable key for the music to be performed is automatically designated based on chord performance information.

2. Prior Art

With the progress in an automatic technique of an electronic musical instrument and the like, several automatic accompaniment apparatuses have been developed in recent years. Such automatic accompaniment apparatus automatically generates additional tones such as duet tones, arpeggio tones, bass tones etc. based on melody performance, chord performance etc. These additional tones are automatically sounded with performance tones such as a melody tone and chord. Thus, the music can be performed with much variety in its performance manners. In this case, the additional tone can be generated based on the chord only. However, in order to generate the additional tone suitable for the tune to be performed, it is desirable to set the key (such as major key, minor key etc.) of the tune.

Therefore, U.S. Pat. No. 4,419,916 discloses the electronic musical instrument which, prior to the performance, designates the key by operations of a minor key switch and keys of keyboard (hereinafter, referred to keyboard keys). For example, when the performer simultaneously operates a major key switch and a keyboard key corresponding to a C note, the C major key is designated.

However, in the above-mentioned conventional electronic musical instrument, the performer must designate the key by himself. Therefore, this is disadvantageous in that the preparation of the performance becomes troublesome for the performer due to such key designation. In addition, if the performer does not know the key of the tune, the performer can not designate the key. Further, the above key designation is made by using the keyboard, so that the key designation can not be made in the middle of the performance. Furthermore, it is impossible to effect a modulation (i.e., change of key) in the middle of the performance.

Meanwhile, Japanese Patent Laid-Open Publication No. 61-292692 discloses the automatic accompaniment apparatus which automatically generates accompaniment tones such as the arpeggio tones, bass tones etc. This apparatus provides an accompaniment pattern memory for storing pitch difference data indicative of a pitch difference between certain tone and root of chord in accordance with the rhythm progression by each rhythm kind and each chord type. Then, in response to the selected rhythm and the type of chord which is performed by the keyboard, the pitch difference data is read from the accompaniment pattern memory in accordance with the rhythm progression. By adding the read pitch differece data to root note data indicative of the root of chord to be performed, accompaniment tone data indicative of the tone pitch of the accompaniment tone is formed. Thus, the accompaniment tone indicated by the accompaniment tone data is to be sounded.

However, in the above conventional apparatus, the read-out of the pitch difference data from the accompaniment pattern memory is controlled by the rhythm kind and chord type only. Therefore, in order to prevent the musically inadequate accompaniment tone from being sounded, the pitch difference data which can be stored in the accompaniment pattern memory and used for generating the accompaniment tone must be limited to that indicative of the notes such as a basic constituent note and a tension note concerning the chord to be performed. As a result, the accompaniment tone to be generated may be suitable for the ordinary music. However, the succession of accompaniment tones sounds monotonous, thus this conventional apparatus is disadvantageous in that the accompaniment full of variety can not be obtained.

U.S. Pat. No. 4,184,401 discloses the electronic musical instrument which detects the chord in response to the combination of plural note name information. This conventional electronic musical instrument provides a shift register having twelve bits each corresponding to each note of the 12-note scale. In this case, "1" is set to the bit positions of the shift register corresponding to the plural note names which are designated by simultaneously depressing the keyboard keys. Then, until the combination of parallel outputs from the shift register coincides with any one of predetermined combinations each indicative of each of predetermined chord types (such as major, minor, seventh etc.), a series of data stored at the bits of the shift register is circulatingly shifted. When the above combination coincides with that of certain chord type, this chord type is selected. In addition, in response to the circulatingly bit-shifting times of the shift register, the root of chord is determined. Thus, the chord is detected in response to the combination of depressed keyboard keys.

In the above conventional electronic musical instrument, the chord is determined at the firstly detected combination in the circulatingly bit-shifting of the shift register. Therefore, if another combination to be detected exists, such combination must be neglected. So, if the firstly detected combination corresponds to the chord to be selected by the performer, there is no problem. However, if not, the wrong chord is detected. Particularly, in the case where many kinds of chord types are set in the apparatus of U.S. Pat. No. 4,184,401 or the performer designates the chord including the tension note, there are complicated combinations among the note names. Therefore, as the number of the chord types and the notes to be designated becomes larger, the frequency of errors (i.e., wrong detections) becomes larger. Further, when the performer touches or depresses the keyboard key by mistake, this frequency becomes further larger.

When the above wrong detection of the chord is occurred, the third apparatus can not generate the correct automatic accompaniment tones such as the arpeggio tones, bass tones etc. which are generated in response to the detected chord. Therefore, the above conventional electronic musical instrument is disadvantageous in that its quality of the automatic accompaniment tone must be lowered.

SUMMARY OF THE INVENTION

It is accordingly a primary object of the present invention to provide an electronic musical instrument which generates tonality data by which the tonality suitable for the tune to be performed is automatically designated in accordance with the music theory.

It is another object of the present invention to provide an electronic musical instrument capable of generating the additional tones adequate to the tune to be performed by use of tonality data for designating the tonality, wherein the additional tones are duet tones, arpeggio tone, bass tones and the like.

It is still another object of the present invention to provide an electronic musical instrument which prevents the musically inadequate accompaniment tones from being generated but which complicates the succession of accompaniment tones so that the accompaniment full of variety can be obtained.

It is a further object of the present invention to provide an electronic musical instrument capable of correctly detecting the chord corresponding to the performer's will in response to the combination of designated note names within the plural note names.

In a first aspect of the invention, there is provided an electronic musical instrument having an automatic tonality designating function comprising:

(a) chord designating means for designating a chord;

(b) chord information storing means having plural storing areas which can store plural chord information in a period of time, the chord information storing means replacing the oldest chord information stored therein with another new chord information indicative of the chord which is newly designated by the chord designating means;

(c) judging means for judging whether or not the chord information storing means stores all chord information indicative of plural specific chords each of which is predetermined for each key; and (d) tonality data setting means for automatically setting key data indicative of a key corresponding to the specific chord based on a judgement result of the judging means, whereby a desirable tonality is automatically designated by the tonality data.

In a second aspect of the invention, there is provided an electronic musical instrument having an automatic key designating function comprising:

(a) note name information inputting means for inputting note name information indicative of a note name;

(b) chord detecting means for detecting a chord based on the note name information to be inputted;

(c) chord information storing means having plural storing areas which can store plural chord information indicative of the chord detected by the chord detecting means in a lapse of time, the chord information storing means replacing the oldest chord information stored therein with another new chord information indicative of the chord which is newly detected by the chord detecting means;

(d) judging means for judging whether or not the chord information storing means stores all chord information indicative of plural specific chords each of which is predetermined for each key; and (e) key data setting means capable of automatically setting key data indicative of a key corresponding to the specific chord based on a judgement result of the judging means, whereby a desirable key is to be automatically designated by the key data.

In a third aspect of the invention, there is provided an electronic musical instrument having an automatic key designating function comprising:

(a) rhythm designating means for designating a rhythm kind of a rhythm performance to be performed;

(b) chord designating means for designating a chord;

(c) chord information storing means for storing chord information indicative of the chord designated by the chord designating means; and (d) key designating means for automatically designating a desirable key in accordance with a predetermined condition corresponding to the rhythm kind designated by the rhythm designating means based on the chord information stored in the chord information storing means, wherein the predetermined condition being set by each of the rhythm kinds to be designated by the rhythm.

In a fourth aspect of the invention, there is provide an electronic musical instrument having an automatic key designating function comprising:

(a) rhythm designating means for designating a rhythm kind of a rhythm performance to be performed;

(b) note name information inputting means for inputting note name information indicative of a note name;

(c) chord detecting means for detecting a chord based on the note name information;

(d) chord information storing means for storing chord information indicative of the chord detected by the chord detecting means; and (e) key designating means for automatically designating a desirable key in accordance with a predetermined condition corresponding to the rhythm kind designated by the rhythm designating means based on the chord information stored in the chord information storing means, wherein the predetermined condition being set by each of the rhythm kinds to be designated by the rhythm designating means.

In a fifth aspect of the invention, there is provided an electronic musical instrument comprising:

(a) chord designating means for designating a chord;

(b) mode determining means for determining a mode in response to the chord designated by the chord designating means;

(c) rhythm designating means for designating a rhythm kind of a rhythm performance to be performed;

(d) accompaniment pattern generating means for generating pitch difference data in response to the mode determined by the mode determining means and the rhythm kind designated by the rhythm designating means, the pitch difference data indicating a pitch difference from a tone pitch of a base note which is preset for the mode, the pitch difference data being outputted in accordance with a rhythm progression;

(e) adding means for adding the pitch difference data with root data indicative of a root of the chord designated by the chord designating means to thereby obtain accompaniment tone data indicative of a tone pitch of an accompaniment tone to be performed; and (f) accompaniment tone signal generating means for generating an accompaniment tone signal having the tone pitch indicated by the accompaniment tone data, whereby an automatic accompaniment is performed in accordance with the accompaniment tone signal.

In a sixth aspect of the invention, there is provided an electronic musical instrument comprising:

(a) chord designating means for designating a chord;

(b) key designating means for designating a key;

(c) mode determining means for determining a mode in response to the chord designated by the chord designating means and the key designating by the key designating means;

(d) rhythm designating means for designating a rhythm kind of a rhythm performance to be performed;

(e) accompaniment pattern generating means for generating pitch difference data in response to the mode determined by the mode determining means and the rhythm kind designated by the rhythm designating means, the pitch difference data indicating a pitch difference from a tone pitch of a base note which is preset for the mode, the pitch difference data being outputted in accordance with a rhythm progression;

(f) adding means for adding the pitch difference data with root data indicative of a root of the chord designated by the chord designating means to thereby obtain accompaniment tone data indicative of a tone pitch of an accompaniment tone to be performed; and (g) accompaniment tone signal generating means for generating an accompaniment tone signal having the tone pitch indicated by the accompaniment tone data, whereby an automatic accompaniment is performed in accordance with the accompaniment tone signal.

In a seventh aspect of the invention, there is provided an electronic musical instrument which inputs plural note name information each indicative of each of note names within a scale so that a chord is to be detected in response to a combination of the plural note name information, the electronic musical instrument comprising:

(a) chord storing means for storing chord information indicative of the chord to be detected;

(b) chord extracting means for extracting plural chords each having a root whose note name is designated in response to the combination of the plural note name information to be inputted; and (c) chord designating means for newly designating a desirable chord among the plural chords extracted by the chord extracting means, the desirable chord has a predetermined chord progression relation to a precedingly designated chord indicated by the chord information stored in the chord storing means, the chord designating means writing new chord information indicative of the desirable chord into the chord storing means.

In an eighth aspect of the invention, there is provided an electronic musical instrument which inputs plural note name information each indicative of each of note names within a scale so that a chord is to be detected in response to a combination of the plural note name information, the electronic musical instrument comprising:

(a) chord storing means for storing chord information indicative of the chord to be detected;

(b) key designating means for designating a key;

(c) chord extracting means for extracting plural chords each having a root whose note name is designated in response to the combination of the plural note name information to be inputted; and (d) chord designating means for newly designating a desirable chord among the plural chords extracted by the chord extracting means based on the key designated by the key designating means and a precedingly designated chord indicated by the chord information stored in the chord storing means, the desirable chord has a predetermined chord progression relation to the precedingly designated chord in the designated key, the chord designating means writing new chord information indicative of the desirable chord into the chord storing means.

In a ninth aspect of the invention, there is provided an electronic musical instrument which inputs plural note name information each indicative of each of note names within a scale so that a chord is to be detected in response to a combination of the plural note name information, the electronic musical instrument comprising:

(a) key designating means for designating a key;

(b) chord extracting means for extracting plural chords each having a root whose note name is designated in response to the combination of the plural note name information to be inputted; and (c) chord designating means for designating a specific chord in the key designated by the key designating means among the plural chords extracted by the chord extracting means, the specific chord being used as a detected chord.

In a tenth aspect of the invention, there is provided an electronic musical instrument which inputs plural note name information each indicative of each of note names within a scale so that a chord is to be detected in response to a combination of the plural note name information, the electronic musical instrument comprising:

(a) chord storing means for storing chord information indicative of the chord to be detected;

(b) key designating means for designating a key;

(c) chord extracting means for extracting plural chords each having a root whose note name is designated in response to the combination of the plural note name information to be inputted; and (d) chord designating means for newly designating a desirable chord among the plural chords extracted by the chord extracting means wherein each chord has its own tension degree which is determined in response to the key designated by the key designating means, the tension degree of the desirable chord has a predetermined relation to a tension degree of a precedingly designated chord indicated by the chord information stored in the chord storing means, the chord designating means writing new chord information indicative of the desirable chord into the chord storing means.

In an eleventh aspect of the invention, there is provided an electronic musical instrument which detects a chord based on a combination of plural note name information each indicative of each of plural note names within a scale, the electronic musical instrument comprising:

(a) chord extracting means for extracting plural chords each having a root which corresponds to each of the plural note names designated by the plural note name information to be inputted; and (b) chord selecting means for selecting a desirable chord among the plural chords extracted by the chord extracting means wherein each of the plural chords relates to its own tension note whose note name is included in the plural note names, the desirable chord having the tension note concerning a tension degree which is the smallest among all tension notes relating to the plural chords.

In a twelfth aspect of the invention, there is provided an electronic musical instrument having an automatic key designating function comprising:

(a) chord designating means for designating a chord;

(b) chord information storing means for storing chord information indicative of the chord designated by the chord designating means;

(c) chord progression detecting means for detecting a predetermined specific chord progression in response to a preceding chord and a current chord at least, wherein the preceding chord being indicated by the chord information stored in the chord information storing means and the current chord is newly designated by the chord designating means; and (d) key data setting means for setting key data indicative of a key corresponding to the specific chord progression detected by the chord progression detecting means, whereby a desirable key is automatically designated by the key data.

In a thirteenth aspect of the invention, there is provided an electronic musical instrument having an automatic key designating function comprising:

(a) chord designating means for designating a chord;

(b) chord information storing means providing plural storing areas each capable of storing chord information in a lapse of time, wherein old chord information indicative of the oldest chord among plural chords stored in the plural storing areas being replaced by new chord information indicative of the chord newly designated by the chord designating means;

(c) chord progression detecting means for detecting a predetermined specific chord progression in response to a preceding chord and a current chord at least, wherein the preceding chord being indicated by the chord information stored in the chord information storing means and the current chord is newly designated by the chord designating means;

(d) means for determining plural temporary keys based on the specific chord progression detected by the chord progression detecting means and the plural chord information stored in the chord information storing means, the means then examining a harmonic degree between each of the temporary keys and each of the plural chords indicated by the plural chord information; and (d) key data setting means for setting key data indicative of the temporary key whose harmonic degree is the highest, whereby a desirable key is automatically designated by the key data.

In a fourteenth aspect of the invention, there is provided an electronic musical instrument having an automatic key designating function comprising:

(a) plural performance members each corresponding to each of plural note names included in a scale;

(b) chord detecting means for detecting a chord in response to a combination of the performance members to be simultaneously operated;

(c) chord information storing means for storing chord information indicative of the chord detected by the chord detecting means;

(d) note name information storing means providing plural storing areas each capable of storing note name information indicative of the note name, the note name information storing means capable of storing plural groups of simultaneously operated note name information, each group of simultaneously operated note name information indicating simultaneously operated note names corresponding to the performance members to be simultaneously operated, the note name information storing means replacing the oldest group of simultaneously operated note name information with the newest group of simultaneously operated note name information;

(e) chord progression detecting means for detecting a predetermined specific chord progression in response to a preceding chord and a current chord, wherein the preceding chord being indicated by the chord information stored in the chord information storing means and the current chord is newly designated by the chord detecting means;

(f) means for determining plural temporary keys based on the specific chord progression detected by the chord progression detecting means and the note name information stored in the note name information storing means, the means then examining whether the note name information storing means stores the note name information concerning the note name adequate to or inadequate to the temporary key; and (g) key data setting means for setting key data indicative of one of the temporary keys which is selected based on an examination result of the means, whereby a desirable key is automatically designated by the key data.

In a fifteenth aspect of the invention, there is provided an electronic musical instrument having an automatic key designating function comprising:

(a) input means for inputting note name information indicative of a note name;

(b) chord detecting means for detecting a chord based on the note name information inputted by the inputting means;

(c) chord information storing means for storing chord information indicative of the chord detected by the chord detecting means;

(d) chord progression detecting means for detecting a predetermined specific chord progression in response to a preceding chord and a current chord at least, wherein the preceding chord being indicated by the chord information stored in the chord information storing means and the current chord is newly designated by the chord detecting means; and (e) key data setting means for setting key data indicative of a key corresponding to the specific chord progression detected by the chord progression detecting means, whereby a desirable key is automatically designated by the key data.

In a sixteenth aspect of the invention, there is provided an electronic musical instrument having an automatic key designating function comprising:

(a) chord designating means for designating a chord;

(b) temporary key determining means for determining a temporary key corresponding to the chord designated by the chord designating means;

(c) first storing means providing plural storing areas capable of storing data indicative of times of determing the temporary key by each key;

(d) incrementing means for incrementing the data stored in the storing means every time the temporary key determining means determines the temporary key;

(e) second storing means for storing key data indicative of a finally determined key; and (f) changing means for changing the key data stored in the second storing means based on a result of comparing the times of determining the temporary key with another times of determining the finally determined key, whereby a desirable key is automatically designated by the key data.

BRIEF DESCRIPTION OF THE DRAWINGS

Further objects and advantages of the present invention will be apparent from the following description, reference being had to the accompanying drawings wherein a preferred embodiment of the present invention is clearly shown.

In the drawings:

FIGS. 2A to 2I are drawings showing detailed configurations of several tables, registers to be set within a working memory shown in FIG. 1;

FIGS. 3A, 3C, 3D, 3E and 3F are drawings showing detailed configurations of several detection tables shown in FIG. 1.

DESCRIPTION OF A PREFERRED EMBODIMENT

[A] Basic Principle of the Invention

Figure 1:
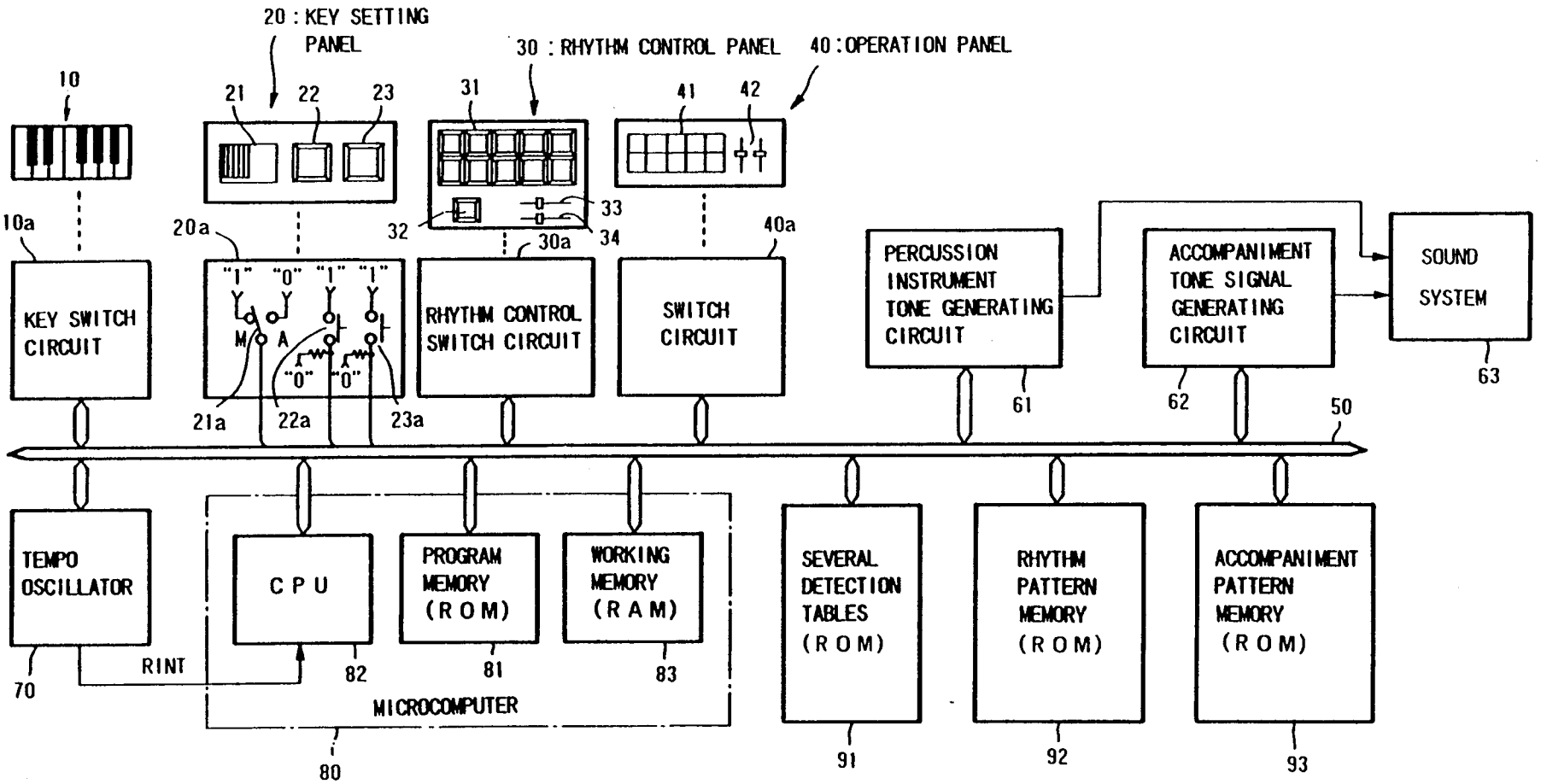
FIG. 1 is a block diagram showing the whole configuration of the electronic musical instrument according to an embodiment of the present invention.

In a first aspect of the invention, when the chords are sequentially designated, the memory stores the chord information indicative of the designated note. Then, when it is detected that the memory stores all of the chord information indicative of the plural specific chords which are predetermined by each key, the key data indicative of the key corresponding to the specific chords is set.

In general, in one tune, there is a tendency in which the specific chord progression is made in each key in response to the rhythm kind such as the march, waltz, blues etc., or another tendency in which the specific chord groups emerge within the certainly short period in each key. For example, in certain rhythm kind, the specific chord progression remarkably emerges in each key based on the Cadence Theory of the succession of chords. More specifically, in case of C major, the chord is progressed from G major to C major or from $D^b$ major to C major. In case of C minor, the chord is progressed from G minor to C minor. On the other hand, in the blues, for example, the chords of I-degree Seventh, IV-degree Seventh, V-degree Seventh (e.g., C Seventh, F seventh, G Seventh in case of the C major key) tend to emerge within the certainly short period, wherein this major key is set as the base note. On the other hand, in the minor key of the blues, other chords of I-degree Minor Seventh, IV-degree Minor Seventh, V-degree Minor Seventh (e.g., C Minor Seventh, F Minor Seventh, G Minor Seventh in case of the C minor key) tend to emerge within certainly short period, wherein this minor key is set as the base note.

As a result, without any trouble of the performer, the key or tonality corresponding to the musical theory can be automatically designated based on the above-mentioned tendency even if the performer does not know the key of the tune to be performed or even in the middle of the performance. Then, the designated key is set as the key data. Therefore, by use of such key data, it is possible to form the adequately additional tones for the tune, wherein the additional tones are the duet tones, arpeggio tones, bass tones etc.

In a second aspect of the invention, based on the chord information stored in the memory, the key is designated in accordance with the predetermined condition corresponding to the designated rhythm kind.

In a third aspect of the invention, when the chords are sequentially designated, the mode corresponding to the designated chords is determined. Based on the determined mode and the designated rhythm kind, the pitch difference data indicative of the tone pitch of the tone from the root note of the mode is generated in accordance with the rhythm progression. By adding this pitch difference data to the root note data indicative of the root of designated chord, the accompaniment tone data indicative of the tone pitch of the accompaniment tone is to be formed. Then, the accompaniment tone signal corresponding to this accompaniment tone data is to be generated.

Therefore, it is possible to use all of the notes based on the mode as the accompaniment tone, even if this note is not the basic constituent note of the chord and the tension note. As a result, without generating the musically inadequate tones, a plenty of tones can be used as the accompaniment tones. Thus, it is possible to complicate the succession of accompaniment tones, so that the listener will enjoy the accompaniment music full of variety.

In a fourth aspect of the invention, when new note name information is inputted, plural chords are temporarily extracted, wherein each of these plural chords has the root concerning each of plural note names which are designated by the new note name information. Within these plural chords, one chord is selected as a new chord, wherein the predetermined chord progression relation is established between this selected chord and the preceding chord. Then, new chord information indicative of this new chord is stored in the memory.

In the meantime, the chord progression in the tune has the specific progression mode based on the music theory. For example, based on the cadence theory, the chord type is varied from Seventh or Seventh Suspended 4 to Major. In addition, the root of chord descends by every semitone interval by 7-note or 1-note, i.e., the chord is varied from $G_{7th}$ to $C_{Maj}$ or from $D^b{}_{7th}$(SUS4) to $C_{Maj}$. Hence, by selecting the predetermined chord progression in advance, the chord suitable for the music theory is eventually designated.

In this case, it is also possible to designate the new chord in consideration of the key which is automatically designated in response to the designated chord or which is designated by operating the key designating switch and the like.

By using the key, it is possible to designate the chord in response to the following chord progressions: related II of secondary dominant chord group to secondary dominant suspended 4 chord group or secondary dominant chord group (e.g., $E_{m7th}$ to $A_{7th}$(SUS4) or $A_{7th}$ in case of the C key); related II of substituted secondary dominant chord group to substituted secondary dominant suspended 4 chord or substituted secondary dominant chord group (e.g., $A^b{}_{m7th}$ to $D^b{}_{7th}$(SUS4) or $D^b{}_{7th}$ in case of the C key).

Further, it is possible to designate the specific chord in the designated key within the plural chords. In this case, it is possible to use the chord which frequently emerges in the designated key. For example, the primary chord, cadence chord etc. in the minor key (e.g., $C_{m7th}$, $D_{m7th}$, $D_{m7th}(^b5)$, $F_{7th}$ etc. in the C key) can be used.

Furthermore, within the plural chords to be designated, one chord is selected as the new chord, wherein certain relation is established between the tension degrees of this chord and the preceding chord. This tension degree is determined in response to the designated key. Thus, it is possible to designate the chords along the tension line in the succession of chords. In other words, this tension line indicates the progression of tension degrees of the chords.

In a fifth aspect of the invention, plural chords are temporarily extracted based on plural roots of note names designated by plural note name information. In consideration of the tension note included in each of the extracted chords, one chord will be eventually selected. In this case, it is possible to select the chord whose number of tension notes is the smallest or whose tension degree is the smallest, wherein the number of tension notes and the tension degrees are pre-stored by each chord.

[B] Configuration of an Embodiment

Referring now to the drawings, wherein FIG. 1 is a block diagram showing the whole configuration of the electronic musical instrument having the automatic key designating function according to an embodiment of the present invention.

The electronic musical instrument as shown in FIG. 1 provides a keyboard 10, a key setting panel 20, a rhythm control panel 30 and an operation panel 40. The keyboard 10 includes plural keyboard keys for designating the chords. The key-depression/key-release operations of each keyboard key is detected by on/off states of its corresponding key switch which is included within a key switch circuit 10*a*. In addition, this key switch circuit 10*a* includes a chattering preventing circuit, a wait timer circuit etc., which prevent the keyboard key from being touched by mistake. Further, when the plural keyboard keys are depressed with a little time delay, it is also detected as simultaneous key-depressions. Thus, such simultaneous key-depressions are detected as one key-depression event. The key setting panel 20 provides a key setting selection switch 21, a major key switch 22 and a minor key switch 23. The key setting selection switch 21 selects one of an auto-mode in which the key is automatically set in response to the chord performance by the keyboard 10 and a manual mode in which the key is set by the specific key-depression of the keyboard 10. The major key switch 22 is used for designating the major key in the manual mode, while the minor key switch 23 is used for designating the minor key in the manual mode. The operations of this key setting panel 20 are detected by the key setting switch circuit 20*a*, which includes a key setting selection switch 21*a*, a major key switch 22*a* and a minor key switch 23*a* corresponding to the switches 21, 22 and 23 respectively. The rhythm control panel 30 provides rhythm selecting switches 31 for selecting one of rhythm kinds such as the march, waltz, etc.; a start/stop switch 32 for designating the start/stop operations; a tempo control 33 for controlling the rhythm tempo; and a volume control 34 for controlling the tone volume. The operations of these switches 31, 32 and controls 33, 34 are respectively detected by the corresponding switches provided within a rhythm control switch circuit 30*a*. The operation panel 40 provides a plenty of switches 41 and controls 42 for selectively controlling a tone color, tone volume etc. of a musical tone to be generated. The operations of these switches 41 and controls 42 are respectively detected by the corresponding switches and controls provided within a switch circuit 40*a*.

These switch circuits 10*a*, 20*a*, 30*a*, 40*a* are all connected to a bus 50, which is also connected to a percussion instrument tone signal generating circuit 61, an accompaniment tone signal generating circuit 62, a tempo oscillator 70 and a microcomputer 80.

The percussion instrument tone signal generating circuit 61 provides plural channels in which plural musical tone signals corresponding to percussion instruments such as a cymbal, a bass drum etc. are formed. In response to percussion instrument tone data $PITD_1$ to $PITD_m$ outputted from the microcomputer 80 via the bus 50, this circuit 61 forms and outputs the corresponding percussion instrument tone signals. The accompaniment tone signal generating circuit 62 provides plural channels (i.e., n channels) in which plural musical tone signals corresponding to the musical instruments such as a piano, violin etc. In response to tone color data, tone pitch data, key-on signal KON and key-off signal KOF outputted from the microcomputer 80 via the bus 50, this circuit 62 forms and outputs the musical tone signal having the tone color corresponding to the tone color data and the tone pitch corresponding to the tone pitch data. These circuits 61 and 62 are connected to a sound system 63 configured by an amplifier, a speaker etc. Thus, the sound system 63 generates the musical tones corresponding to the signals from the circuits 61 and 62.

The tempo oscillator 70 outputs a rhythm interrupt signal RINT having the predetermined frequency to the microcomputer 80. The frequency of this rhythm interrupt signal RINT is determined by tempo data fed from the microcomputer 80 via the bus 50 in response to the operation of the tempo control 33.

The microcomputer 80 consists of a program memory 81, a central processing unit (CPU) 82 and a working memory 83, all of which are connected to the bus 50. The program memory 81 is constructed by a read-only memory (ROM) which stores a main program and its subprograms, and a rhythm interrupt program shown in FIGS. 5A to 12. When a power switch (not shown) is on, the CPU 82 starts to execute the main program. This main program is repeatedly executed until the power switch is off. When an interrupt signal RINT is fed to the CPU 82, the CPU 82 breaks its execution of the main program and then starts to execute the rhythm interrupt program. The working memory 83 is constructed by a random-access memory (RAM). In this working memory 83, several registers and tables for executing the above-mentioned programs are preset as follows.

Figure 2A:
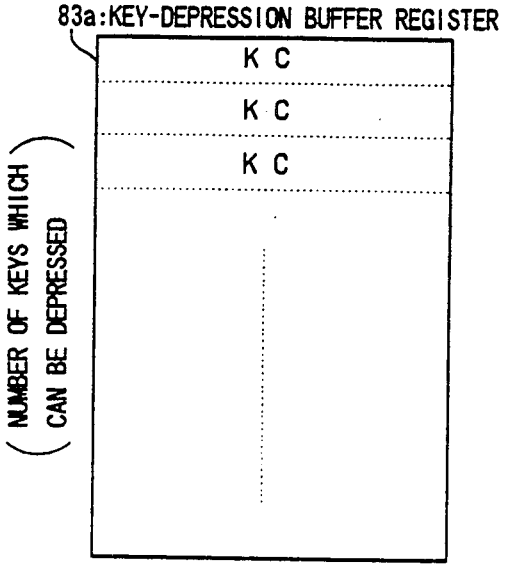

(1) Key-Depression Buffer Register 83*a* (FIG. 2A)

This register 83*a* has the storage area where data of several keys which can be depressed simultaneously can be stored. In order to designate the chord, this register 83*a* stores all of key codes KC indicative of the keys which are simultaneously depressed.

Figure 2B:
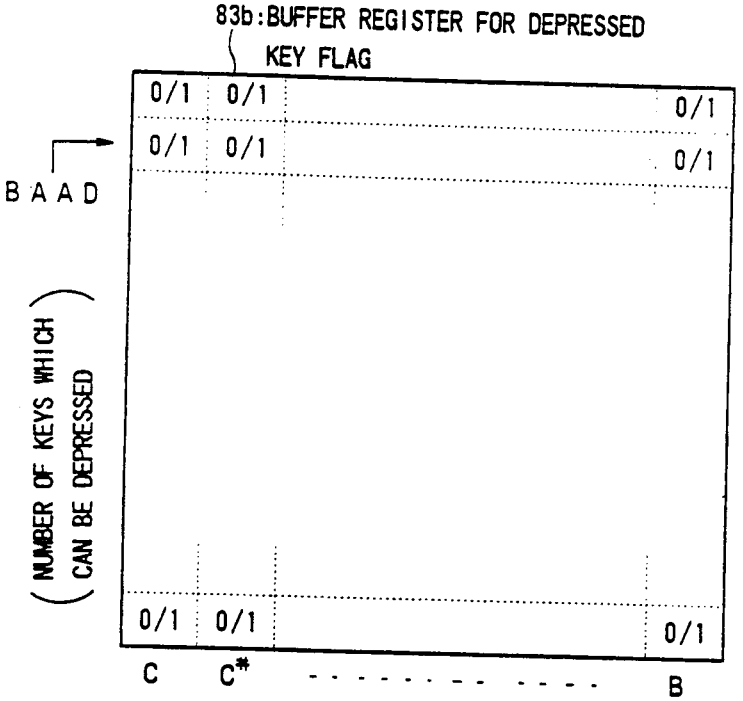

(2) Buffer Register 83*b* For A Depressed Key Flag (FIG. 2B)

Each storing area of this buffer register 83*b* has the bit number corresponding to the 12-note scale. The number of storing areas in this buffer register 83*b* corresponds to the number of keyboard keys which can be simultaneously depressed by the performer. Based on the simultaneously depressed keyboard keys, several chords can be selected. However, there is a possibility in that one or more evasive notes unnecessary to the selected chord are included within the notes designated by the simultaneously depressed keyboard keys. Then, such unnecessary notes are excluded from the designated notes by each chord, so that the notes properly corresponding to the selected chord can be obtained. Thereafter, key-depression flag "1" is set for each of such proper notes by each chord.

Figure 2C:
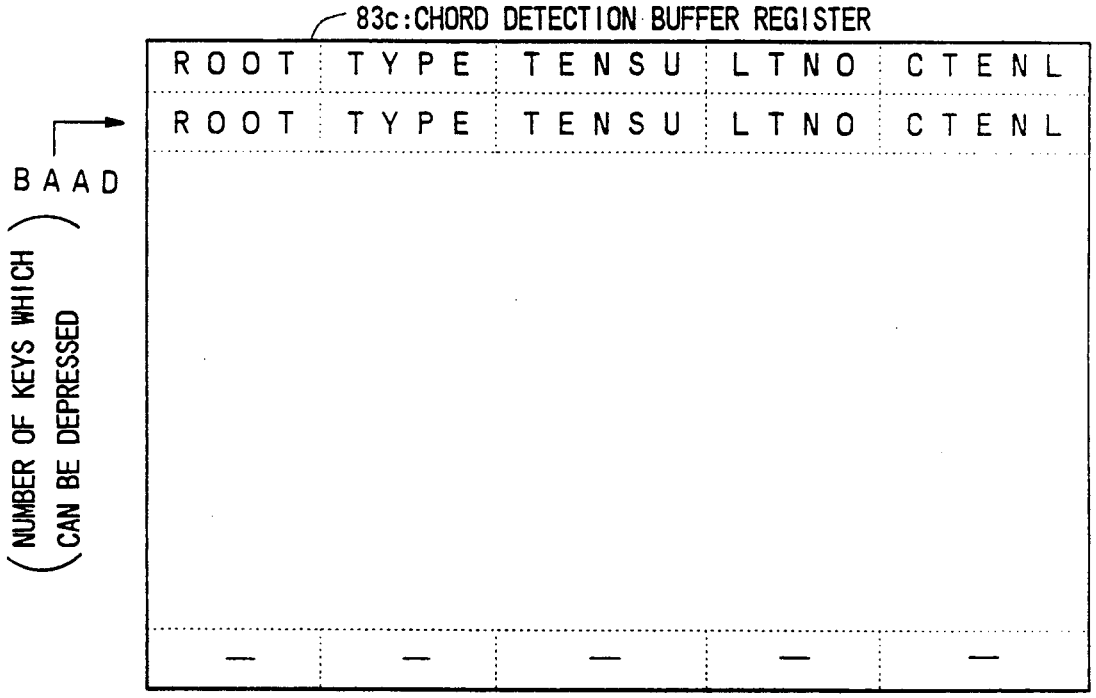

(3) Chord Detection Buffer Register 83c (FIG. 2C)

This buffer register 83c has the storing areas whose number corresponds to the number of keyboard keys which can be simultaneously depressed by the performer. Based on the simultaneously depressed keyboard keys, several chords can be considered to be selected. Each storing area stores several data including ROOT indicative of the root note of the selected chord; TYPE indicative of the chord type; TENSU indicative of the number of tension notes whose keyboard keys are depressed in the selected chord; LTNO indicative of smallest tension note number within all tension note numbers TNO whose keyboard keys are depressed; and CTENL indicative of a chord tension level. Herein, the tension notes are the notes which are additionally sounded with the basic constituent notes of the chord. In case of the chord "minor 7", the basic constituent notes are the notes of "1-degree", "3-degree$^b$", "5-degree", "7-degree$^b$", while the tension notes are the notes of "9-degree", "11-degree". The number TENSU is the number of the additional tones, and the tension note number TNO indicates the "tension degree" of each additional tone. As the tension note number TNO becomes larger, the dissonance of the chord becomes larger (see FIGS. 3A, 3B). Further, the chord tension level CTENL indicates the tension degree of the chord itself. This chord tension level CTENL is set such that the chord which is heard with larger impression for the listener is given the larger value of CTENL but the chord which can be heard softly is given the small value of CTENL (see FIG. 3C).

Figure 2D:
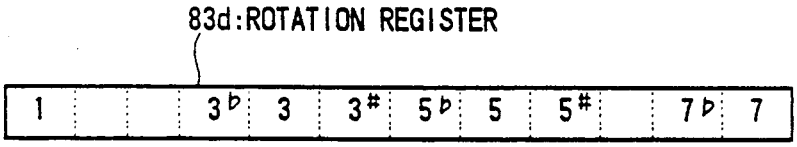
Figure 2D:
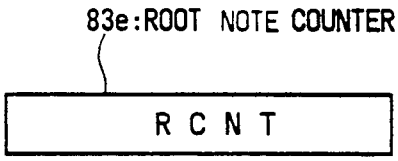

(4) Rotation Register 83d (FIG. 2D)

This rotation register 83d having twelve bits corresponds to the 12-note scale whose several notes corresponding to the simultaneously depressed keyboard keys are given the key-depression flags "1". In order to detect the chord, each bit data of this rotation register 83d is rotated.

(5) Root Tone Counter 83e (FIG. 2D)

The root note counter 83e counts up in synchronism with the rotation of the rotation register 83d. Thus, the data of this root note counter 83e will indicate the key code KC of the root note data ROOT.

(6) Depressed Key Flag Table 83f (FIG. 2E)

This table 83f stores some of the key-depression flags stored in the foregoing buffer register 83b. More specifically, this table 83f stores the key-depression flags concerning eight chords which have been employed as the detected chords.

(7) Chord Table 83g (FIG. 2F)

In response to the key-depression flags stored in the table 83f, this chord table 83g stores the root note data ROOT, chord type data TYPE and chord tension levels CTENL concerning the above eight chords.

(8) Blues Table 83h (FIG. 2G)

This blues table 83h includes matrix storing tables corresponding to the six kinds of chords each having the root note data ROOT indicated by 12-note scale. Namely, these matrix storing areas correspond to the chords $I_7$, $IV_7$, $V_7$, $I_{m7}$, $IV_{m7}$, $V_{m7}$. Each matrix storing area stores the flag "1" indicating the existence of each chord.

(9) Key Flag Table 83i (FIG. 2H)

This key flag table 83i includes the matrix storing areas corresponding to the four kinds of keys each having the root note data ROOT indicated by 12-note scale. Namely, these matrix storing areas correspond to the major key, minor keys of the blues and another major key, minor key of the music other than the blues. Each storing area stores the judging times of each key which changes from "0" to "3".

(10) Other Registers 83j (FIG. 2I)

Each of other registers 83j temporarily stores the following variable data which are necessary to execute the foregoing programs.

(a) Performance Start Flag PSTF: In order to detect the start timing of the performance, this flag PSTF is used. More specifically, PSTF is at "0" just before the performance (i.e., rhythm performance) is started, while PSTF is at "1" just after the performance is started.

(b) Performance Start Minor Flag PSTMF: In order to detect the minor key, this flag PSTMF is used. When PSTMF is at "1", the chord at the start timing of the performance is the minor chord or minor seventh chord. When PSTMF is at "0", this chord is other than the minor chord and minor seventh chord.

(c) Buffer Address BAAD: This buffer address BAAD is the address data for designating each storing area of the buffer register 83b and chord detection buffer register 83c.

(d) Present Table Address CTAD: This present table address CTAD indicates the storing area concerning the newest chord within the depressed key flag table 83f and chord table 83g. This address CTAD repeatedly designates one of eight storing areas in the predetermined order.

(e) Priority Chord Flag PCDF: This priority chord flag PCDF is the flag which indicates whether or not desirable one of plural chords stored in the buffer register 83c is selected by the priority according to the predetermined condition. This PCDF is at "1" when the desirable chord has been already selected, while PCDF is at "0" when such desirable chord has not been selected yet.

(f) Primary Cadence Chord Flag PCCF: This primary cadence chord flag PCCF is the flag by which each of the primary chord and cadence chord is forced to be alternatively selected within the plural chords stored in the chord detection buffer register 83c. The PCCF is at "1" when the cadence chord has been previously selected, while PCCF is at "0" when the primary chord has been previously selected.

(g) Key-Depression Chord Data DPCHD: This data DPCHD indicates the chord which is presently designated by the keyboard 10. This data DPCHD normally consists of the root note data ROOT and chord type data TYPE.

(h) First Tension Level Sum Value SUMTENL1: This value SUMTENL1 indicates the sum value of the chord tension levels CTENL of the eight chords which have been previously selected, wherein the eight chords correspond to one key and these are stored in the chord table 83g.

(i) Second Tension Level Sum Value SUMTENL2: Similar to the above value SUMTENL1, this value SUMTENL2 indicates the sum value of the chord tension levels CTENL of the eight chords which have been previously selected, wherein the eight chords correspond to one key and these are stored in the chord table 83g.

(j) Temporary Key Data KMKD: Before the key is finally determined, this temporary key data KMKD indicates the key which is temporarily determined in accordance with the predetermined condition. The most significant bit (MSB) of this data KMKD indicates the major or minor key, while other bits thereof indicates the key (e.g., C key, G key etc.) which is designated by the key code KC.

(k) Key Data MKD: This key data MKD indicates the finally determined key. Similar to KMKD, the MSB of this data MKD indicates the major or minor key, while other bits thereof indicates the key which is designated by the key code KC.

(l) Key Setting Flag MKSF: This key setting glag MKSF indicates whether or not the key has been already set. This flag MKSF is at "0" before the key is set, while MKSF is at "1" after the key is set.

(m) Mode Data SCALE: This mode data SCALE indicates the musical mode such as Ionian, Dorian etc.

(n) Rhythm Kind Data RHY: This rhythm kind data RHY indicates the rhythm kind such as the blues, march, waltz etc.

(o) Rhythm Run Flag RUN: This rhythm run flag RUN indicates the states of auto-rhythm performance. The flag RUN is at "1" when the auto-rhythm performance is made, while RUN is at "0" when the auto-rhythm performance is stopped.

(p) Tempo Count Data TCNT

This tempo count data TCNT is the count data indicative of the progression of auto-rhythm performance, wherein the count value thereof changes from "0" to "31" by every one bar or every two bars.

Furthermore, the bus 50 is connected to several detection tables 91, a rhythm patter memory 92 and an accompaniment pattern memory 93. The several detection tables 91 are stored in the memory constructed by ROM, wherein a chord constituent note table 91*a*, a chord tension table 91*b*, a primary/cadence chord table 91*c*, a first mode table 91*d* and a second mode table 91*e* are included therein.

Figure 3B:
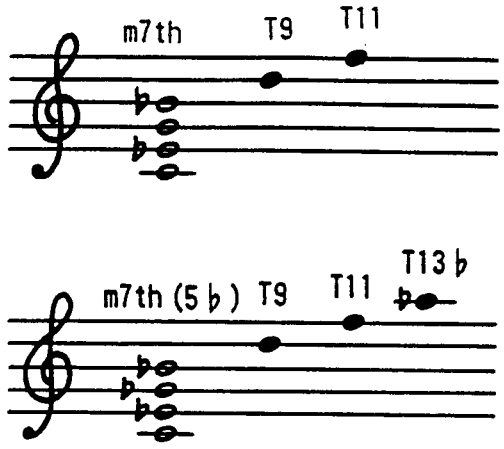
FIG. 3B shows notes as an example of a detected chord.

In response to the chords such as $m7_{th}$, $m7_{th}(^{b}5)$, $7_{th}$, Maj, SUS4 as shown in FIG. 3A to be detected by the present electronic musical instrument, the chord constituent note table 91*a* stores the basic chord constituent notes and tension notes as shown in FIGS. 3A and 3B. In addition, this table 91*a* stores the tension note number TNO corresponding to each tension note (see the number in parentheses in FIG. 3A). For example, in case of the chord $m7_{th}$, the basic chord constituent notes are 1-degree, 3-degree$^{b}$, 5-degree, 7-degree$^{b}$, and the tension notes are 9-degree, 11-degree. Incidentally, the expression of chord used in the present embodiment will be described as follows. Hereinafter, the chord in the parentheses [ ] is the chord whose root note ROOT is the C note.

| | |
|---|---|
| Major | Maj [$C_{Maj}$] |
| Minor | Min [$C_{Min}$] |
| Seventh | 7th [$C_{7th}$] |
| Minor Seventh | m7th [$C_{m7th}$] |
| Minor Seventh Flat 5 | m7th($^{b}$5) [$C_{m7th}(^{b}5)$] |
| Suspended 4 | SUS4 [$C_{SUS4}$] |
| Seventh Suspended 4 | 7th(SUS4) [$C_{7th}$(SUS4)] |
| Augmentation | Aug [$C_{AUG}$] |
| Diminish | Dim [$C_{DIM}$] |

As shown in FIG. 3C, the chord tension table 91*b* stores the chord data (see the chord expression in parentheses of FIG. 3C) concerning several kinds of chords based on the C major, wherein the chord data are classified into seven groups. In addition, this table 91*b* stores the chord tension level CTENL by each chord. Incidentally, FIG. 3C shows the chord name (e.g., $I_{Maj}$, $III_{m7th}$) which expresses each chord by degree and the chord group name such as the primary chord, related II of secondary dominant etc.

The primary/cadence chord table 91*c*, as shown in FIG. 3D, stores the primary chords and cadence chords by each group, wherein each chord is designated by its corresponding degree. Such degree corresponds to the chord name based on the C major. For example, $I_{m7th}$ corresponds to the chord $C_{m7th}$.

Figure 3G:
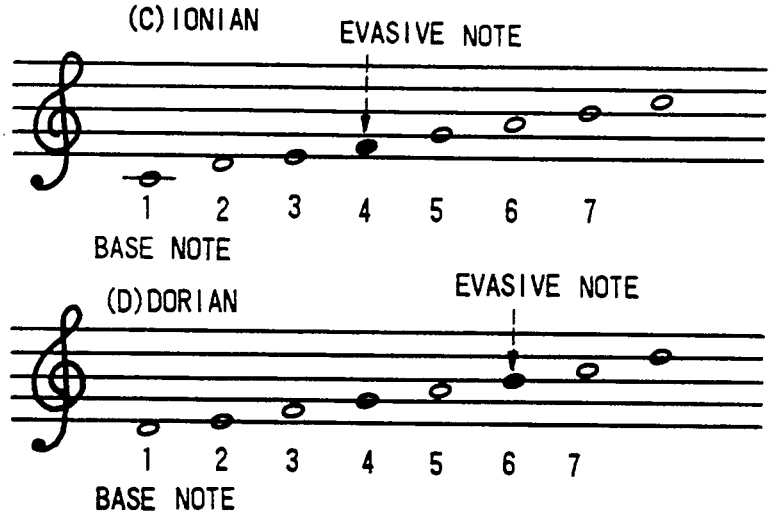
FIG. 3G shows notes as an example of a mode.

The first mode table 91*d*, as shown in FIG. 3E, is the table used for determining the mode such as the Ionian, Dorian (see FIG. 3G) after determining the key. This table 91*d* stores the data indicative of several modes by each chord name expressed by the degree or by each chord group. On the other hand, the second mode table 91*e*, as shown in FIG. 3F, is the table used for determining the mode before determining the key. Namely, this table 91*e* stores the data indicative of several modes by each chord type TYPE such as Maj, Min.

Figure 4A:
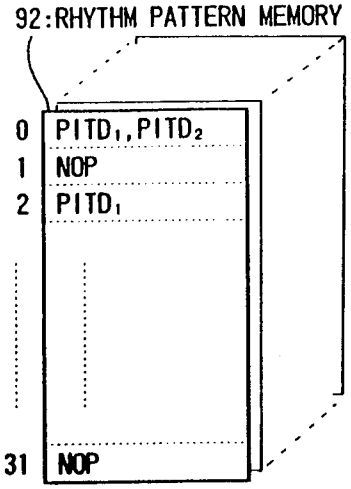
FIG. 4A shows detailed configuration of a rhythm pattern memory shown in FIG. 1.

The storing area of the rhythm pattern memory 92 is divided into plural pattern memory areas by the rhythm kinds as shown in FIG. 4A, wherein each pattern memory has thirty two addresses which are designated by the tempo count data TCNT (0–31). At each address of each pattern memory area, one or more percussion instrument tone data PITD indicative of the percussion instruments such as the cymbal, bass drum etc. whose tones are to be sounded are stored. In addition, at the address which does not correspond to the tone-generation timing of the percussion instrument tone, data NOP indicative of nontoneprocessing is stored.

Figure 4B:
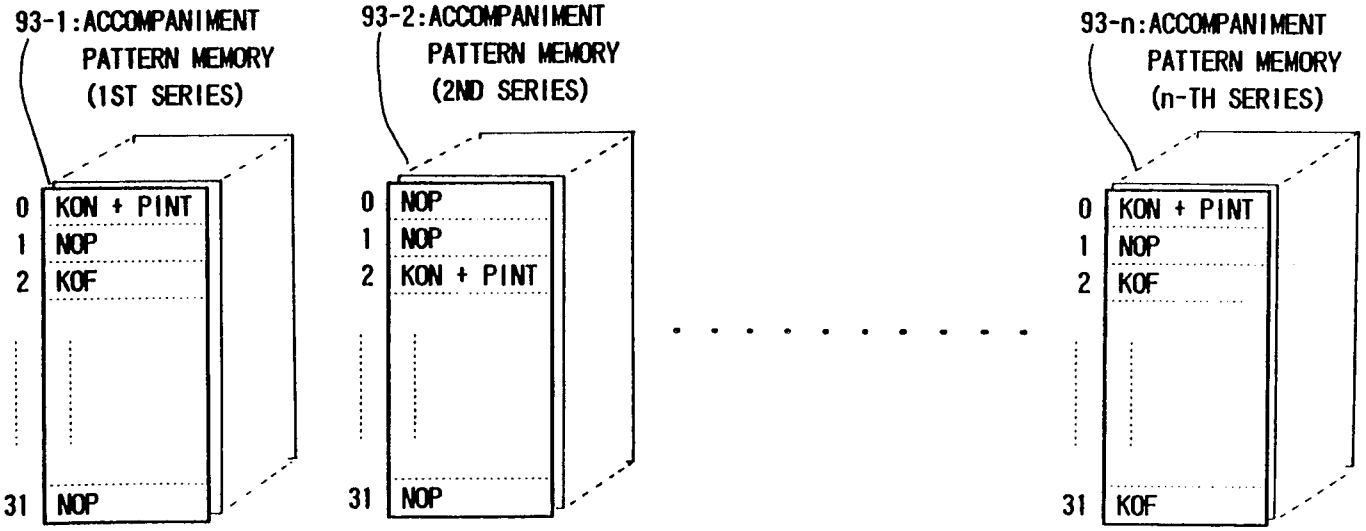
FIG. 4B shows detailed configuration of an accompaniment pattern memory shown in FIG. 1.

The accompaniment pattern memory 93 provides plural series of accompaniment pattern memory areas 93-1, 93-2, . . . , 93-n (where n denotes an arbitrary integral number) each corresponding to each of plural accompaniment tones such as the arpeggio tone, bass tone etc. as shown in FIG. 4B. Each accompaniment pattern memory area is further divided into plural pattern memory areas each having thirty two addresses designated by the tempo count data TCNT (0–31). Each address stores the key-on data KON indicative the key-on event for generating each accompaniment tone, interval data PINT for determining the pitch of each accompaniment tone and key-off data KOF indicative of the key-off event for terminating the generation of each accompaniment tone. Herein, the interval data PINT designates the notes on the scale concerning each mode except unnecessary notes, wherein each note is indicated by semitone interval from the base note (i.e., root note ROOT) of each mode. Further, at the address which does not concern the generation timing of each accompaniment tone, the foregoing data NOP is stored.

[C] Diagrammatical Description of the Whole Operation

This electronic musical instrument determines the mode based on the chord which is finally designated, the determined key and rhythm kind. In response to the determined mode and designated chord, it determines the accompaniment tone which is the most suitable, and then such accompaniment tone is automatically sounded in response to the rhythm.

For this reason, it is necessary to determine the designated chord as accurately and rapidly as possible. This chord is detected by different methods before and after determining the key. More specifically, before determining the key, the chord which seems to be the most suitable is determined by use of the information concerning the key. On the other hand, after determining the key, the chord is determined based on the above chord which has been determined before determining the key. The key is manually designated by the performer. Or, the key which seems to be the most suitable is automatically determined in the above process of detecting the chord. In principle, the mode is determined based on the chord and key, and then the accompaniment pattern data is generated based on the mode and rhythm kind. Thus, it is possible to obtain the accompaniment tone corresponding to the accompaniment pattern data and chord. Before determining the key, the accompaniment pattern data corresponding to the detected chord and rhythm kind is outputted, by which the accompaniment tone is obtained based on the accompaniment pattern data and rhythm kind.

[D] Detailed Description of Operations of an Embodiment

Next, detailed description will be given with respect to the operations of the present embodiment by each program and each routine.

(1) MAIN PROGRAM

Figure 5A:
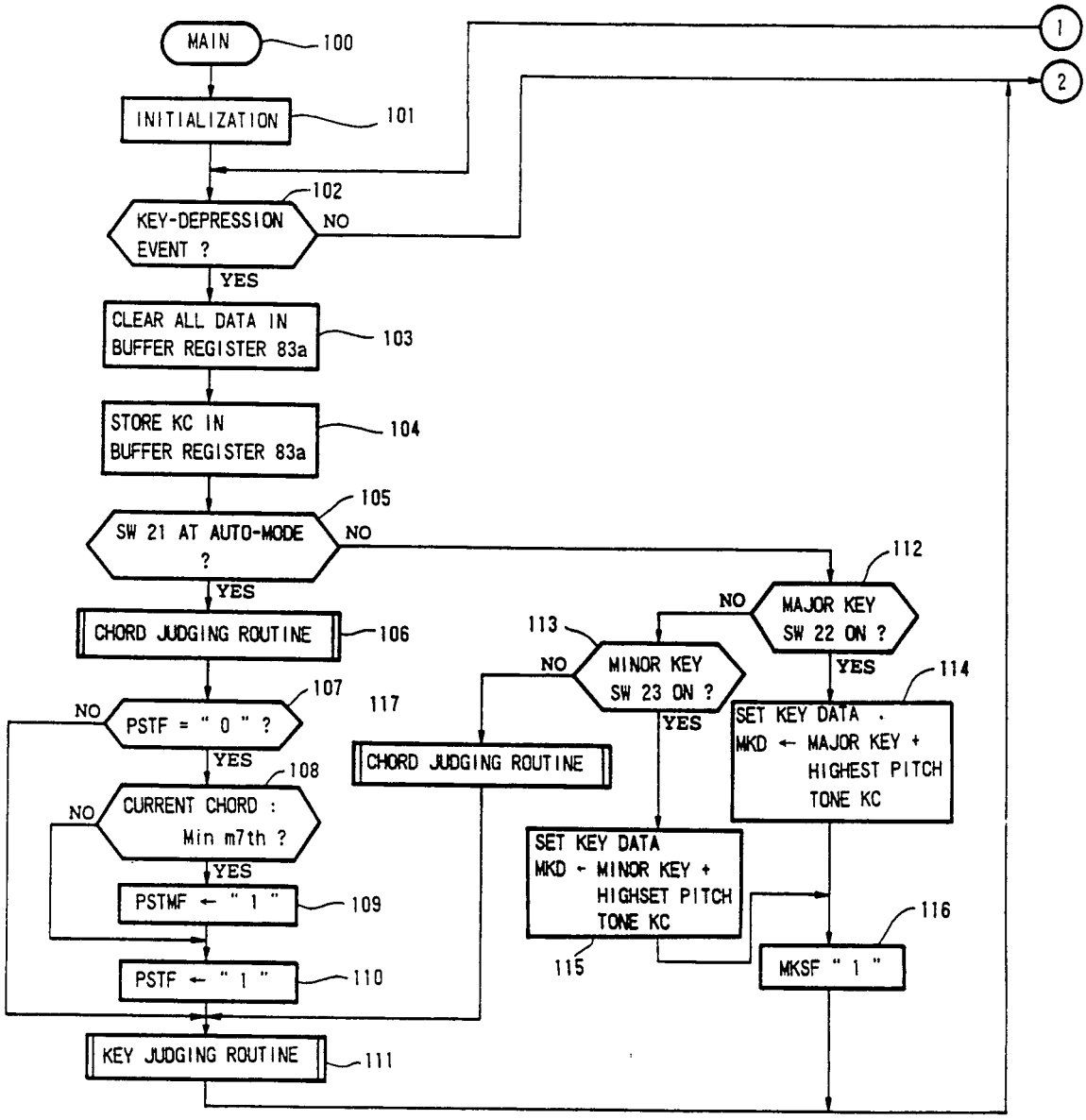
FIGS. 5A to 12 are drawing showing flowcharts of programs to be executed by a microcomputer shown in FIG. 1.
Figure 5B:
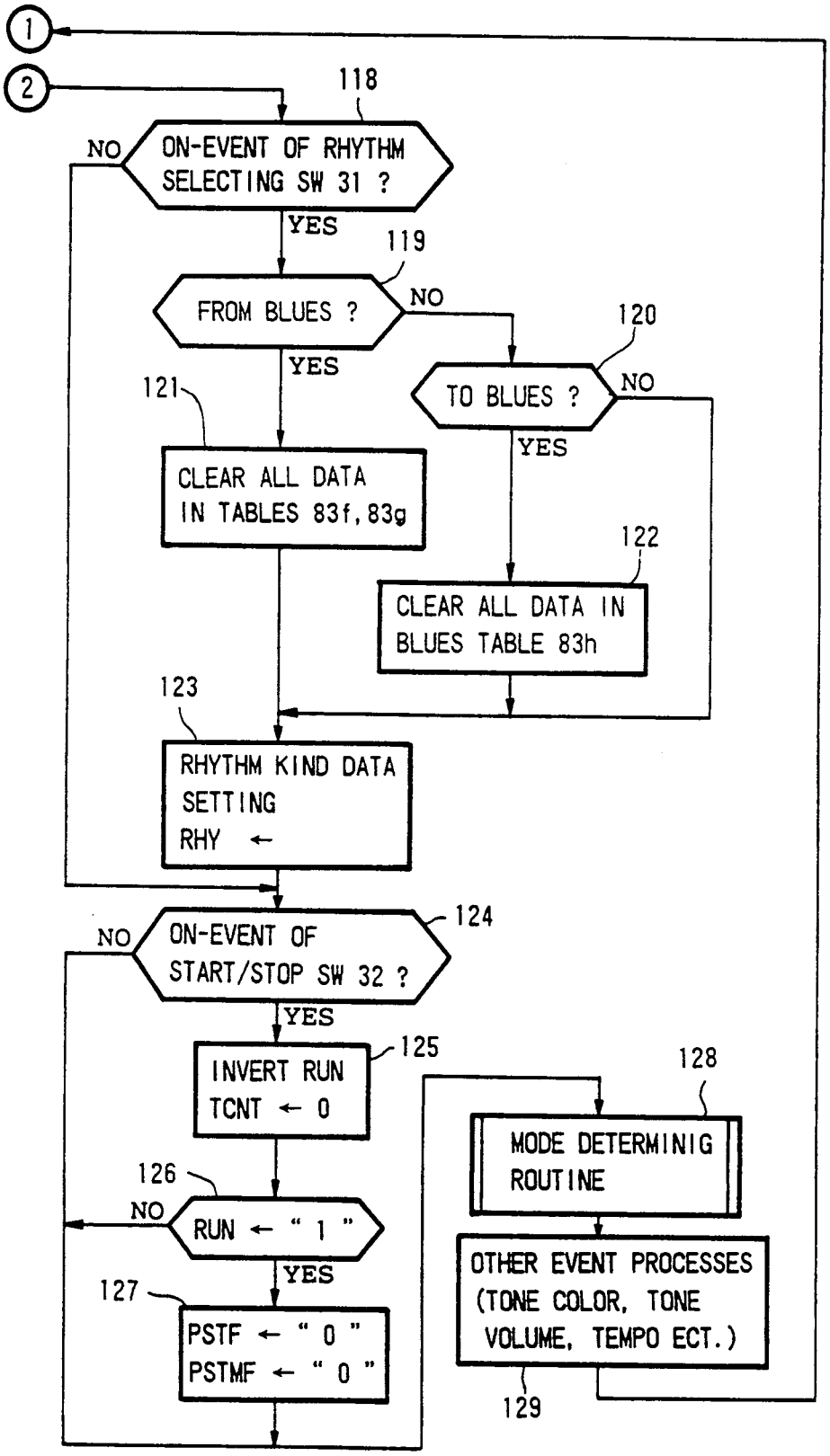

The execution of this main program as shown in FIGS. 5A and 5B is started by turning on a power switch (not shown) in step 100. In step 101, several variable data in the working memory 83 are initialized. After executing such initialization process of step 101, the CPU 82 starts to execute the circulating processes consisting of steps 102 to 129.

In step 102, it is judged whether or not any key-depression event exists, wherein the key-depression event is detected when any keyboard key is depressed. If the judgement result of this step 102 is "NO", the processing proceeds to step 118 shown in FIG. 5B. On the other hand, if the judgement result of step 102 is "YES" because there exists the key-depression event, the processing proceeds to step 103 wherein all data in the key-depression buffer register 83*a* are cleared. In step 104, all key codes KC concerning the simultaneously depressed keyboard keys are written into the buffer register 83*a* via the bus 50.

In next step 105, it is judged whether or not the key setting selection switch 21*a* is set to the auto-mode side. When this switch 21*a* is set to the auto-mode side in response to the operation of the key setting selection switch 21, the judgement result of step 105 turns to "YES" so that a chord judging routine of step 106 is to be executed. In this routine of step 106, the chord designated by the keyboard 10 is detected. The details of this chord judging routine will be described later. Next, it is judged whether or not the performance start flag PSTF is at "0" in step 107. When this flag PSTF is at "0" just after the performance is started, the judgement result of step 107 turns to "YES", so that the processing proceeds to step 108. This step 108 judges the kind of present chord which is determined by the chord judging routine and indicated by the depressed key chord data DPCHD. If the present chord is the Min chord or m7th chord, the judgement result of step 108 turns to "YES" so that the performance start minor flag PSTMF is set at "1" in step 109. If not, the judgement result of step 108 is "NO" so that the performance start minor flag PSTMF remains at "0". Then, the performance start flag PSTF is set at "1" in step 110, which indicates that the performance is not started at the present timing. Thereafter, the processing proceeds to step 111. On the other hand, if the performance start flag PSTF is set at "1" before the judging process of step 107, i.e., at the performance start timing, the processing directly proceeds to step 111 from step 107. In a key judging routine of step 111, the key is automatically determining based on the detected chord. The details of this key judging routine will be described later. Incidentally, the above-mentioned processes of steps 107 to 110 are used for judging whether the chord at the performance start timing is the Min chord or m7th chord, which is one condition for detecting the minor key.

Meanwhile, when the key setting selection switch 21*a* is set to the manual-mode side in response to the operation of the switch 21, the judgement result of step 105 turns to "NO" so that it is judged whether or not the major key switch 22*a* or minor key switch 23*a* is on in steps 112 and 113. Such judgement is used for judging whether the key-depression of the keyboard 10 is made for the key setting or chord designation. When the major key switch 22*a* (22) is on, the judgement result of step 112 turns to "YES" so that the processing proceeds to step 114. In step 114, the MSB of the key data MKD is set at "1" which indicates the major key, while other lower bits thereof are set to the key code KC stored in the buffer register 83*a*, wherein this key code KC concerns the depressed keyboard key having the highest tone pitch among the plural depressed keyboard keys. On the other hand, when the minor key switch 23*a* (23) is on, the judgement result of step 112 turns to "NO" and the judgement result of step 113 turns to "YES" so that the processing proceeds to step 115. In step 115, the MSB of the key data MKD is set at "0" indicating the minor key, and other lower bits thereof are set to the key code KC stored in the buffer register 83*a*, wherein this key code KC concerns the depressed keyboard key having the highest tone pitch among the plural depressed keyboard keys. After executing the processes of steps 114 and 115, the processing proceeds to step 116 wherein the key setting flag MKSF is set at "1". Thereafter, the processing proceeds to step 118 shown in FIG. 5B. As described heretofore, when the key setting selection switch 21 is set to the manual-mode side, due to the processes of steps 112 to 116, the key data MKD is set in response to the key-depression of keyboard 10, the operation of the major key switch 22 or minor key switch 23 provided in the key setting panel 20.

If both of the major key switch 22*a* and minor key switch 23*a* are not on, the judgement results of steps 112, 113 both turn to "NO" so that the processing proceeds to step 117 wherein the chord judging routine similar to that of step 106 is to be executed. Then, the processing proceeds to the key judging routine of step 111.

In step 118 shown in FIG. 5B, it is judged whether or not there exists any on-event of the rhythm selecting switch. If any one of the rhythm selecting switches 31 is not operated, the judgement result of step 118 turns to "NO" so that the processing proceeds to step 124. On the other hand, if the rhythm selecting switch is operated, the judgement result of step 118 turns to "YES" so that the processing proceeds to steps 119, 120. In step 119, it is judged whether or not the precedingly selected rhythm kind indicated by the rhythm kind data RHY designates the blues but the newly selected rhythm kind does not designate the music other than the blues. In step 120, it is judged whether or not the precedingly selected rhythm kind designates the music other than the blues but the newly selected rhythm kind designate the blues. If the selected rhythm kind is changed from the blues to another music, the judgement result of step 119 turns to "YES" so that the processing proceeds to step 121 wherein all data in the depressed key flag table 83*f* and chord table 83*g* are cleared. Then, in step 123, the rhythm kind data RHY is set such that RHY will designate the music other than the blues. On the other hand, if the selected rhythm kind is changed from the music other than the blues to the blues, the judgement result of step 119 is "NO" but the judgement result of step 120 is "YES" so that the processing proceeds to step 122 wherein all data in the blues table 83*h* are cleared. In next step 123, the rhythm kind data RHY is set such that RHY will designate the blues. Therefore, the process of step 123 to which the processing proceeds via step 121 is different from that of step 123 to which the processing proceeds via step 122. Incidentally, if the present condition does not match the conditions of steps 119, 120, the processing directly proceeds to step 123 via steps 119, 120. In this case, the rhythm kind data RHY is renewed by the data indicative of the newly selected rhythm kind in step 123.

In next step 124, it is judged whether or not there exists any on-event of the start/stop switch. If the start/stop switch 32 is not operated, the judgement result of step 124 turns to "NO" so that the processing proceeds to step 128. On the other hand, if the start/-stop switch 32 is operated, the judgement result of step 124 turns to "YES" so that the processing proceeds to step 125. In step 125, the rhythm run flag RUN is inverted and the tempo count data TCNT is initialized to "0". Herein, due to the inversion of the rhythm run flag RUN, the value "0" (or "1") of RUN is varied to "1" (or "0"). In next step 126, it is judged whether or not the inverted rhythm run flag RUN is at "1". In the case where the rhythm performance has been stopped but is started now, the rhythm run flag RUN is at "1" so that the judgement result of step 126 is "YES". In this case, the processing proceeds to step 127 wherein both of the performance start flag PSTF and performance start minor flag PSTMF are initialized to "0". In contrast, in the case where the rhythm performance has been made but is stopped now, RUN is at "0" so that the judgement result of step 126 turns to "NO". Then, the processing directly proceeds to step 128 from step 126.

Step 128 indicates a mode determining routine whose details will be described later. In this mode determining routine, the mode is determined in response to the chord, key etc. in the middle of the performance. Then, the data indicative of the determined mode is set as the mode data SCALE. After executing this routine of step 128, the processing proceeds to step 129 wherein operation event processes are executed on the controls 33, 34 of rhythm control panel 30 and the switches 41, controls 42 of operation panel 40. Due to the process of step 129, the tempo of auto-rhythm and tone color, tone volume of the generated musical tone signal are set and controlled.

(2) CHORD JUDGING ROUTINE

Next, detailed description will be given with respect to the chord judging routine, key judging routine and mode determining routine to be executed in the main program, wherein the chord judging routine is described at first.

Figure 6:
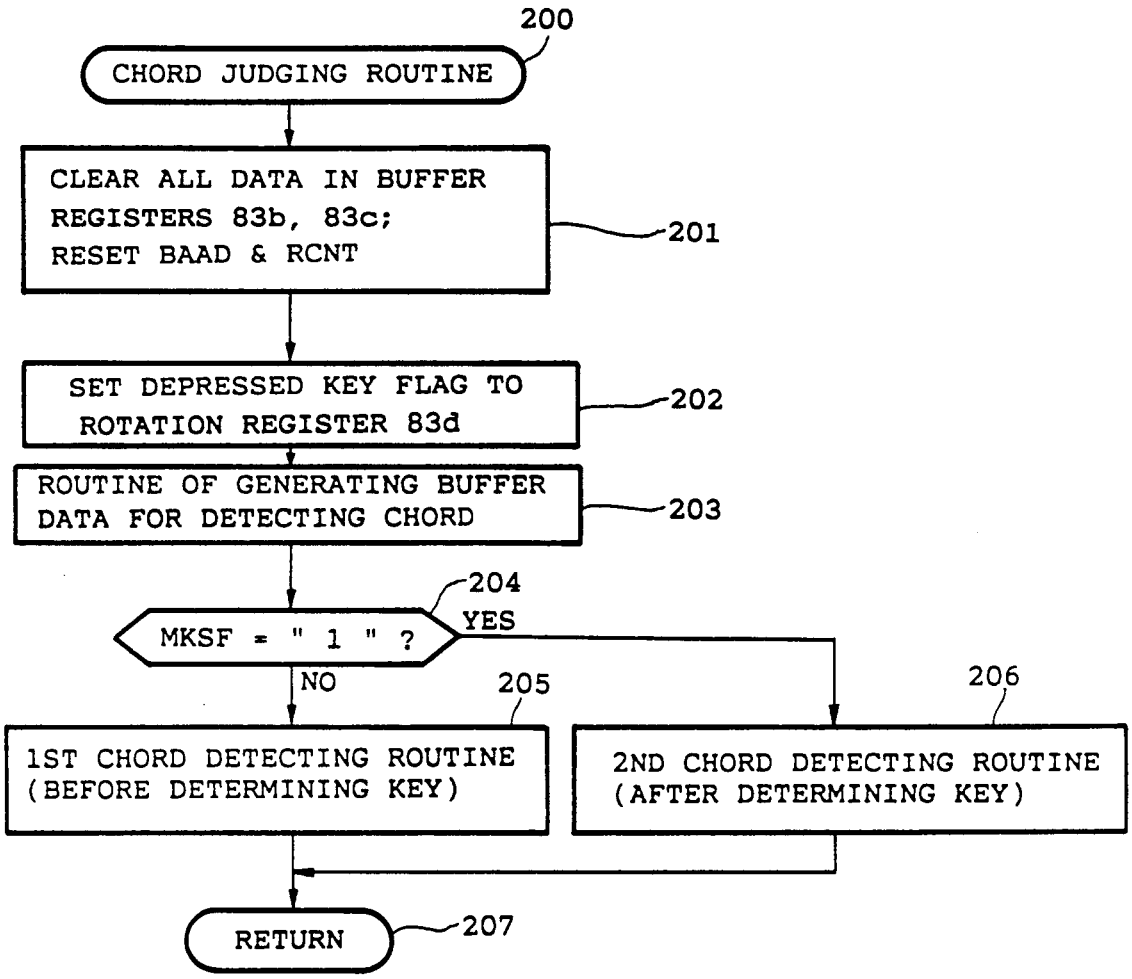

This chord judging routine as shown in FIG. 6 is executed at steps 106, 117 of the main program shown in FIG. 5A, wherein the execution of this routine is started from step 200.

In step 201, all data in the buffer register 83*b* and chord detection buffer register 83*c* are cleared. In addition, the buffer address BAAD and root note count data RCNT (see FIG. 2D) are reset. Thus, the buffer address BAAD indicates the head address of the buffer registers 83*b*, 83*c*, while the root note count data RCNT indicates the key code KC of the C note which is set as the reference note. In next step 202, based on the key code KC stored in the buffer register 83*a*, "1" is set to the bit positions of the rotation register 83*d* (see FIG. 2D) corresponding to the depressed key notes. In the case where the depressed key notes are the C note, E note, G note and B note, for example, "1" is set at bit 1, bit 3, bit 5 and bit 7, while "0" is set at other bits in the rotation register 83*d*. After executing the process of this step 202, the processing proceeds to step 203 wherein a routine of generating buffer data for detecting the chord is to be executed.

Figure 7:
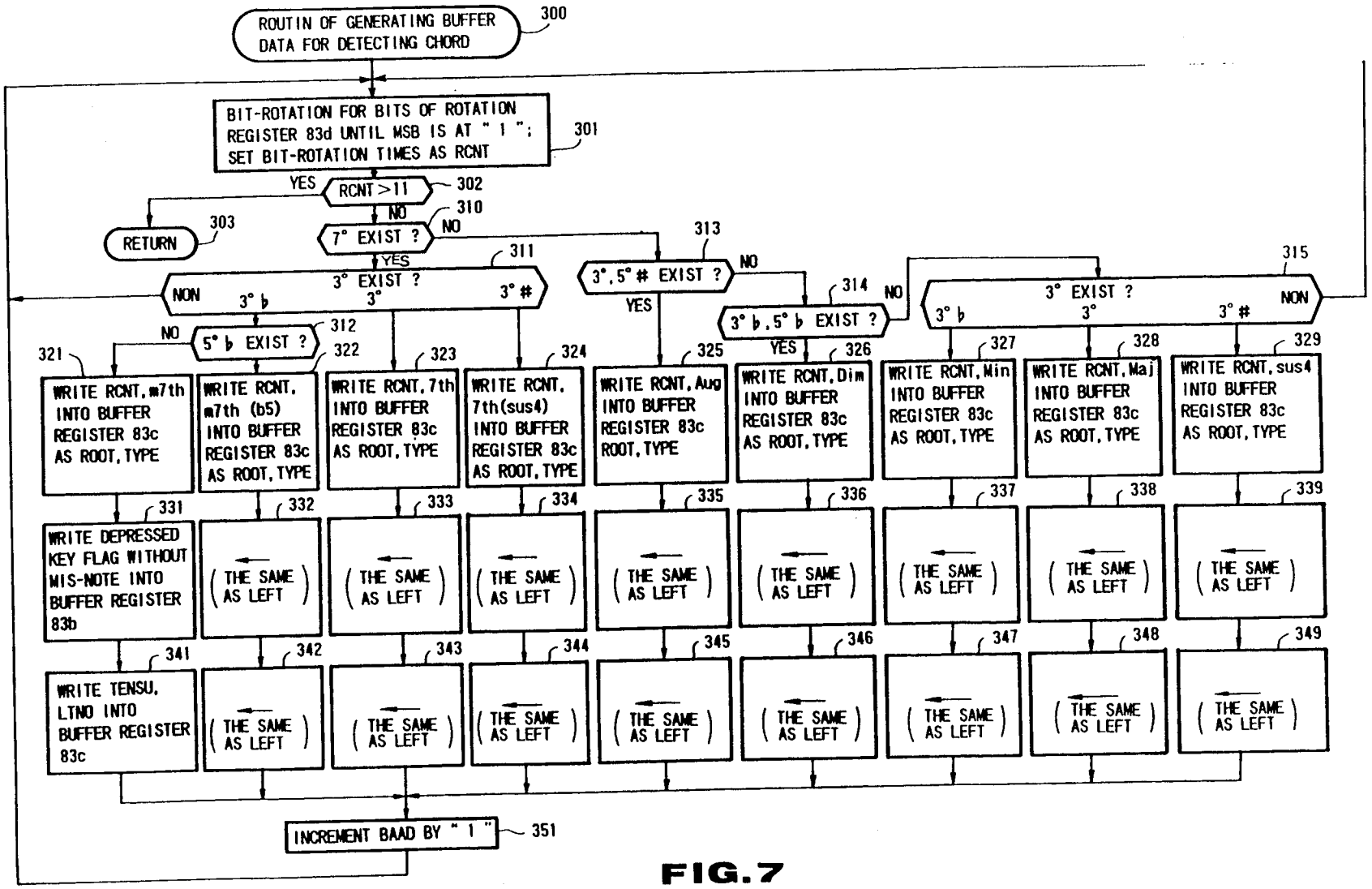

The details of this routine of step 203 is as shown in FIG. 7, wherein this routine is started from step 300. In step 301, the bit values of rotation register 83*d* are sequentially rotated from the right to the left as shown in FIG. 2D until "1" is set to the MSB. Every time the bit values of rotation register 83*d* are rotated, the root note count data RCNT is incremented by "1". Incidentally, in the first operation, when "1" is set at the MSB, the bit-rotation process of this step 301 is omitted and then the processing proceeds to step 302. However, in the second operation or thereafter, even when "1" is set at the MSB, the bit-rotation process of step 301 must be executed and then the processing proceeds to step 302. In step 302, it is judged whether or not the root note count data RCNT exceeds over "11". If the times of executing the bit-rotation is relatively small so that RCNT is less than "11", the judgement result of step 302 turns to "NO" so that the processing enters into a chord searching routine consisting of steps 310 to 315.

In this chord searching routine, the MSB of rotation register 83*d* is set as 1-degree note. By detecting the existence of 3-degree note, 5-degree note, 7-degree note, this routine detects the plural chords which can be designated. Hereinafter, nine kinds of chords and detection methods thereof will described.

(a) m7th chord: This chord is detected under condition where 7-degree note and 3-degree$^b$ note exist but 5-degree$^b$ note does not exist. This is detected by judging processes of steps 310 to 312. Then, the processing proceeds to step 321.

(b) m7th($^b$5) chord: This chord is detected under condition where 7-degree note, 3-degree$^b$ note and 5-degree$^b$ note exist. This is also detected by the judging processes of steps 310 to 312. Then, the processing proceeds to step 322.

(c) 7th chord: This chord is detected by the judging processes of steps 310 and 311 under condition where 7-degree note and 3-degree note exist. Then, the processing proceeds to step 323.

(d) 7th(SUS4) chord: This chord is detected by the judging processes of steps 310 and 311 under condition where 7-degree note and 3-degree$^{190}$ note exist. Then, the processing proceeds to step 324.

(e) Aug chord: This chord is detected by judging processes of steps 310 and 313 under condition where 7-degree note does not exist but 3-degree note and 5-degree$^{\#}$ note exist. Then, the processing proceeds to step 325.

(f) Dim chord:

This chord is detected by judging processes of steps 310, 313 and 314 under condition where 7-degree note does not exist, 3-degree note or 5-degree# note does not exist but 3-degree$^b$ note and 5-degree$^b$ note exist. Then, the processing proceeds to step 326.

(g) Min chord: This chord is detected by judging processes of steps 310, 313 to 315 under condition where 7-degree note does not exist but 3-degree$^b$ note exists and the above-mentioned conditions of (e) and (f) fail to be established. Then, the processing proceeds to step 327.

(h) Maj chord: This chord is detected by the judging processes of steps 310, 313 to 315 under condition where 7-degree note does not exist but 3-degree note exists and the above-mentioned conditions of (e) and (f) fail to be established. Then, the processing proceeds to step 328.

(i) SUS4chord: This chord is detected by the judging processes of steps 310, 313 to 315 under condition where 7-degree note does not exist but 3-degree# note exists and the above-mentioned conditions of (e) and (f) fail to be established. Then, the processing proceeds to step 329.

Due to the above-mentioned chord detection, the processing proceeds to the processes of steps 321 to 329, wherein the root note count data RCNT and type data TYPE indicative of the chord type such as m7th, m7th($^b$5), 7th etc. are respectively written at the addresses of the buffer register 83*c* (see FIG. 2C) which are designated by the buffer address values BAAD. After executing the processes of steps 321 to 329, the processing proceeds to steps 331 to 339. Based on the chord type data TYPE written under the processes of steps 321 to 329, the CPU 82 refers to the chord constituent note table 91*a* (see FIG. 3A), whereby the depressed key flags stored in the rotation register 83*d* are directly transferred to another 12-bit register (not shown) which is constructed as similar to the rotation register 83*d*. Among the depressed key flags whose values at at "1", the flags other than the flag concerning the basic constituent notes and tension notes are delated as the flags of mis-notes (which are the notes unnecessary to the chord designated by mistake). Then, the not-deleted flags are rotated in the right direction by the bits corresponding to the root note data ROOT (i.e., the bit-rotation times of the register 83*d*). Thereafter, these flags are written at the addresses of the buffer register 83*b* (see FIG. 2B) which are designated by the buffer address values BAAD. Thus, the depressed key flags from which the flags corresponding to the mis-notes are omitted and which are at the initial state where the corresponding keyboard keys are depressed are respectively written at the foregoing addresses of the buffer register 83*b*. Next, in steps 341 to 349, the CPU 82 refers to the chord constituent note table 91*a* based on the chord type TYPE, whereby the tension note number TENSU and smallest tension note number LTNO are detected by the depressed key flags written at the addresses of the rotation register 83*d* which are designated by the buffer address values BAAD. In the processes of steps 341 to 349, the mis-notes are neglected naturally. But, in order to execute the chord detection process, the depressed key flags ("1") corresponding to the mis-notes also remains to be stored in the rotation register 83*d*.

After the above steps 341 to 349, the buffer address BAAD is incremented by "1" in step 351. Then, the processing returns to the foregoing step 301. Thereafter, the processes of steps 301, 302, 310 to 315, 321 to 329, 331 to 339, 341 to 349 are to be executed again. In the foregoing chord searching routine, when the chord whose root note does not correspond to the MSB is not detected so that the judgement results of steps 311 and 315 are at "NON", the processing returns to step 301 without incrementing the buffer address BAAD in step 351. Then, the above-mentioned processes of steps 301, 302, 310 to 315, 321 to 329, 331 to 339, 341 to 349 are to be executed again. As a result, the chords whose root notes correspond to the depressed keys are sequentially written into the buffer register 83*c*. In correspondence with the buffer register 83*c*, the depressed key flags except for the flags corresponding to the mis-notes are written into the buffer register 83*b*. When the bit-rotation times of the rotation register 83*d* becomes larger such that the value of root note count data RCNT becomes larger than "12", the judgement result of step 302 turns to "YES" so that the processing of this routine shown in FIG. 7 is terminated in step 303. Then, the processing proceeds to step 204 in FIG. 6.

In step 204, it is judged whether or not the key setting flag MKSF is at "1". This key setting flag MKSF at "0" indicates the timing before the key is set, while MKSF at "1" indicates the timing after the key is set. When it is the timing before the key is set, the judgement result of step 204 turns to "NO" so that the processing proceeds to step 205 of a first chord detecting routine. On the other hand, when it is the timing after the key is set, the judgement result of step 204 turns to "YES" so that the processing proceeds to step 206 of a second chord detecting routine. After these steps 205, 206, the processing proceeds to step 207 whereby the execution of this chord judging routine of FIG. 6 is terminated.

(3) 1ST CHORD DETECTING ROUTINE

Figure 8:
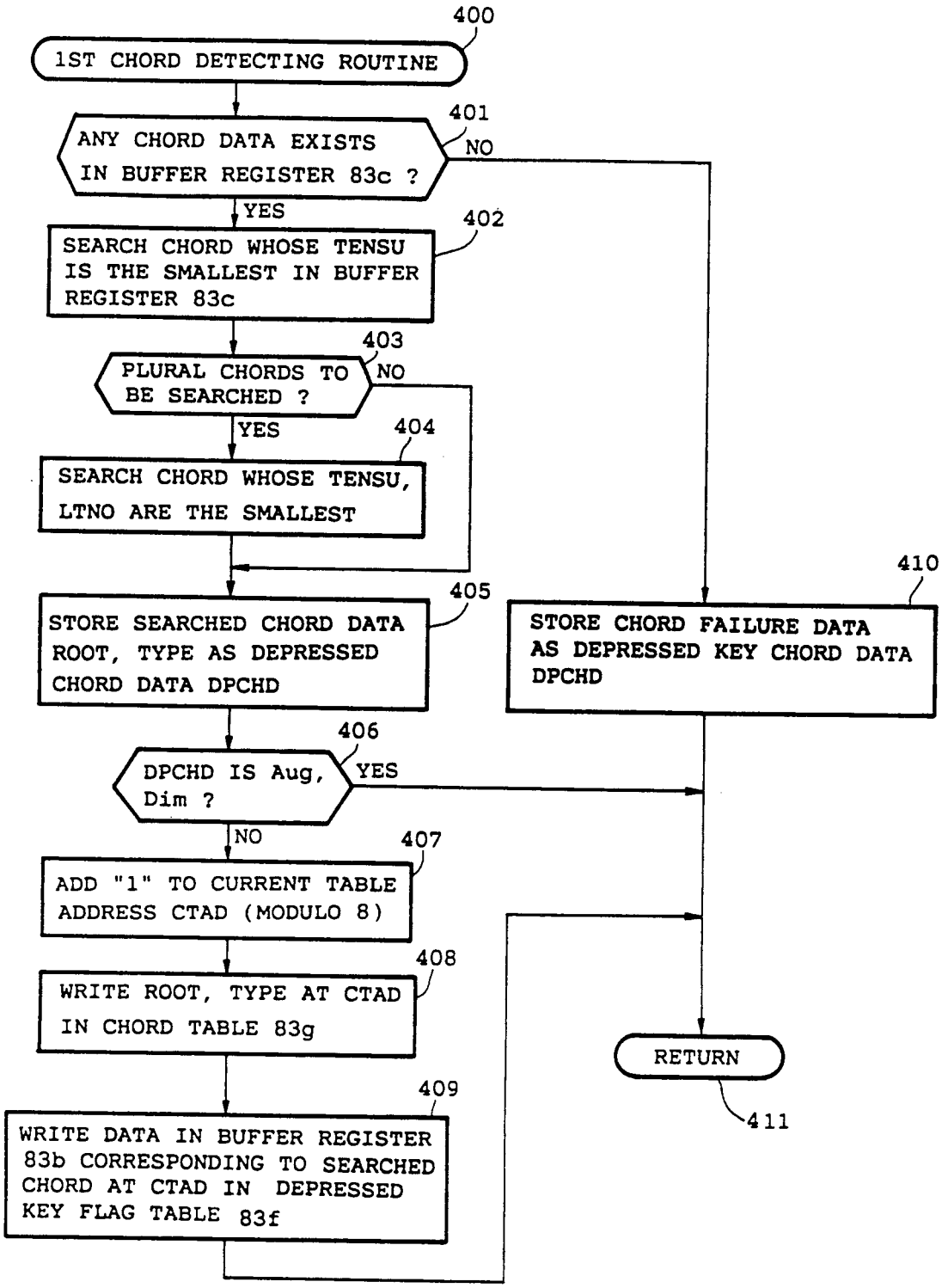

Next, description will be given with respect to the first chord detecting routine as shown in FIG. 8. The execution of this routine is started from step 400, and then it is judged whether or not the buffer register 83*c* stores the chord data such as ROOT and TYPE in step 401. If the buffer register 83*c* stores the chord data therein due to the execution of the foregoing routine of FIG. 7, the judgement result of step 401 turns to "YES" so that the chord data whose tension note number TENSU is the smallest is searched among the chord data stored in the buffer register 83*c* in step 402. After executing this chord searching process of step 402, it is judged whether or not the buffer register 83*c* stores the plural chord data whose tension note number TENSU is the smallest in step 403. If this step 403 judges that the plural chord data exist in the buffer register 83*c*, the judgement result of step 403 turns to "YES" so that the processing proceeds to step 404. In step 404, the chord data corresponding to the smallest tension note number LTNO is searched among the chord data to be searched in step 402 whose tension note numbers TENSU are the smallest in the buffer register 83*c*. In step 405, the data ROOT and TYPE of the chord data searched in step 404 are set and stored as the depressed key chord data DPCHD. On the other hand, if only one chord data is searched in step 402, the judgement result of step 403 turns to "NO" so that the processing directly proceeds to step 405 from step 403. Then, the data ROOT and TYPE of this chord data are set and stored as the depressed key chord data DPCHD in step 405. Due to the processes of steps 402 to 405, it is possible to obtain the most reasonable chord whose tension degree is the lowest without using the key data MKD.

Thereafter, the processing proceeds to step 406 wherein it is judged whether or not the above chord indicates the Aug chord or Dim chord. If so, the judgement result of step 406 is "YES" so that the processing directly proceeds to step 411, whereby the execution of this first chord detecting routine is terminated. If not, the judgement result of step 406 is "NO" so that the processing enters into processes of steps 407 to 409, whereby several data are stored in the tables 83*f* and 83*g*. More specifically, in step 407, "1" is added to the current table address CTAD (i.e., modulo-8 arithmetic). In step 408, the data ROOT and TYPE of the depressed key chord data DPCHD are written at the address of the chord table 83*g* designated by the current table address CTAD. In step 409, the depressed key flag in the buffer register 83*b* which corresponds to the data DPCHD is stored at the address of the table 83*f*. Then, the processing proceeds to step 411, whereby the execution of the first chord detecting routine is terminated. As a result, when any chord is detected in this routine, the chord data concerning the detected chord but not concerning the Aug chord and Dim chord is written into the chord table 83*g*. In addition, the depressed key flags without the flags corresponding to the mis-notes are written into the table 83*f*. Incidentally, the Aug chord and Dim chord are used for varying the chord progression of the tune. Therefore, if these chords are used in the key detecting process, the key can not be detected with accuracy. For this reason, the Aug chord and Dim chord are excluded from the searched chords. Due to the increment operation of step 407, it is possible to repeatedly designate the addresses of the tables 83*f* and 83*g*. In order that the first address (i.e., address 0) is designated for the tables 83*f*, 83*g* in the initial state, the current table address CTAD is initialized to designate the last addresses of the tables 83*f*, 83*g*.

Meanwhile, when any chord data can not be detected in the buffer register 83*c* so that the judgement result of step 401 is "NO", the processing proceeds to step 410 wherein the depressed key chord data DPCHD is set as the chord failure data indicative of the chord failure event. Then, the execution of the first chord detecting routine is terminated in step 411. Similar to the case where the detected chord is the Aug chord or Dim chord, even in case of the chord failure event, the current table address CTAD is not renewed but remained as it were before.

Due to the execution of the processes of steps 400 to 411 in the first chord detecting routine, the key determination is made every time the keyboard key is depressed in the keyboard 10 before the key is determined. Therefore, except for the initial state, previous eight chord data to be used for the key determination are stored in the tables 83*f* and 83*g*.

(4) 2ND CHORD DETECTING ROUTINE

Figure 9A:
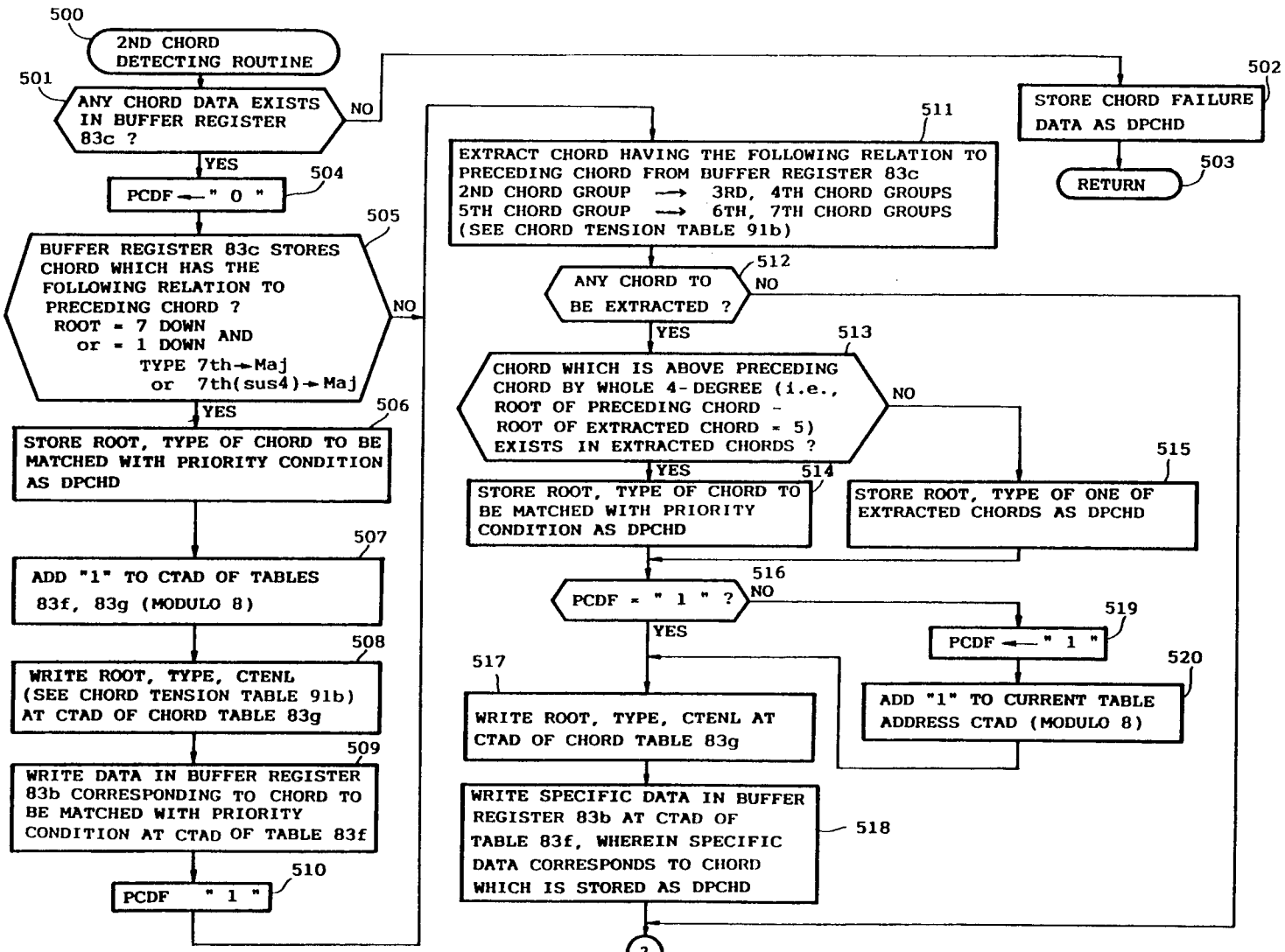
Figure 9B:
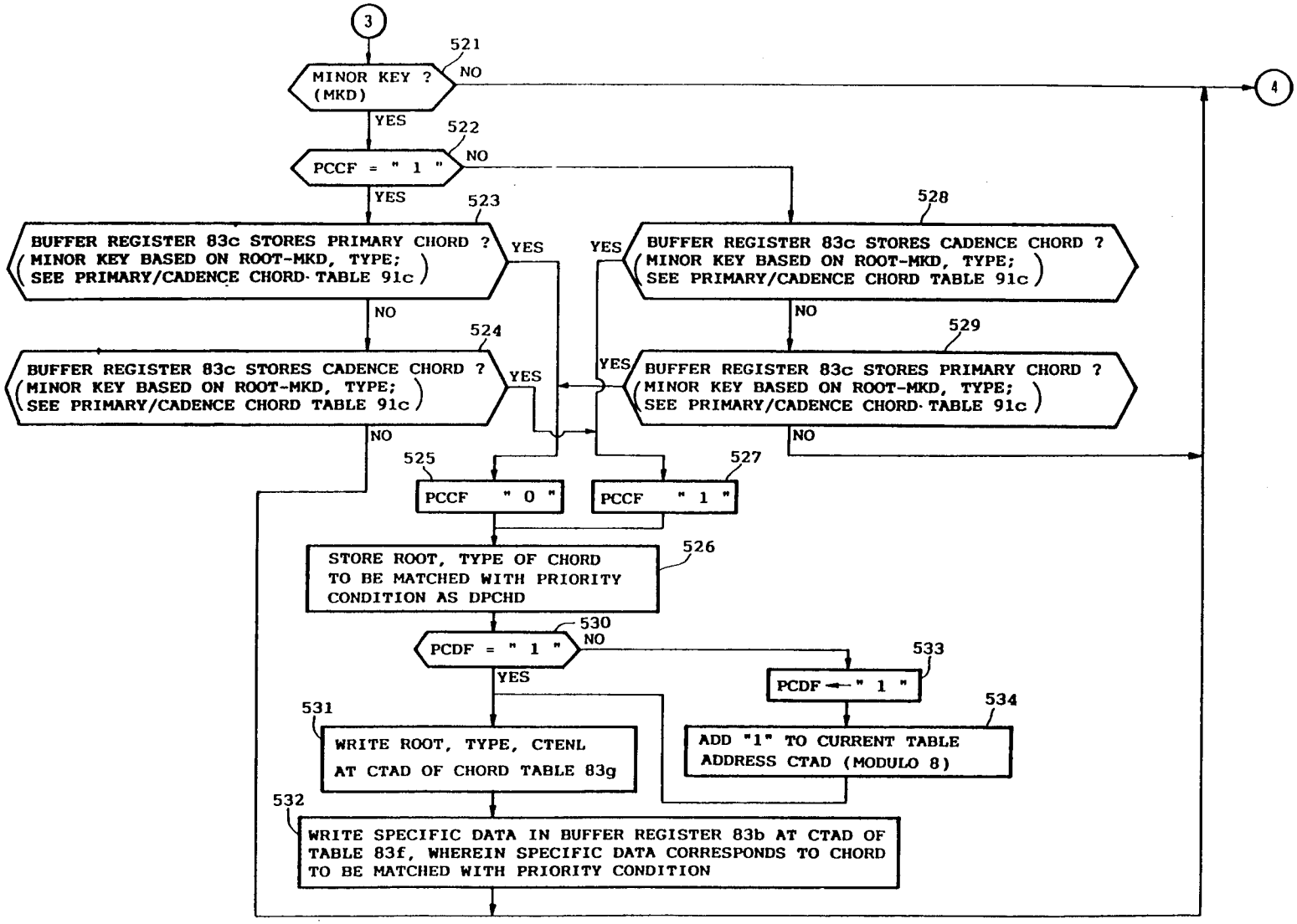
Figure 9C:
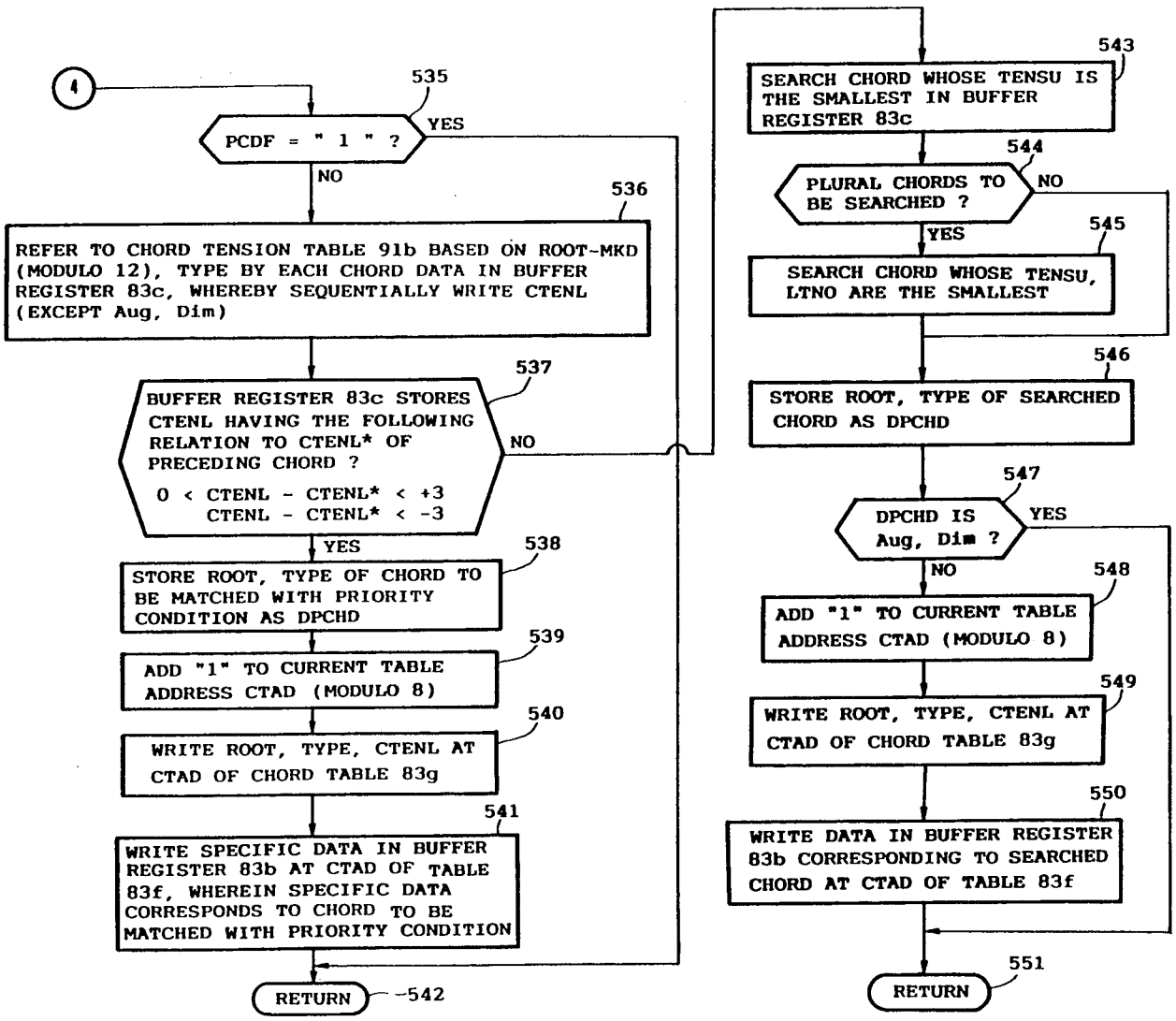

Next, description will be given with respect to the second chord detecting routine which is started in step 205 when the judgement result of step 204 (see FIG. 6) turns to "YES" after the key is determined. This second chord detecting routine as shown in FIGS. 9A to 9C is started from step 500 in FIG. 9A. In step 501, the existence of the chord data such as ROOT, TYPE is judged in the buffer register 83*c*. If there is no chord data stored in the buffer register 83*c* due to the foregoing routine shown in FIG. 7 so that the judgement result of step 501 turns to "NO", the processing proceeds to step 502. Then, similar to the foregoing first chord detecting routine shown in FIG. 8, the chord failure data is set as the depressed key chord data DPCHD in step 502, and the execution of the second chord detecting routine is terminated in step 503.

On the other hand, if the buffer register 83*c* stores the chord data so that the judgement result of step 501 turns to "YES", the processing proceeds to step 504 wherein the priority chord flag PCDF is initialized at "0". Then, in step 505, it is judged whether or not the buffer register 83*c* stores the chord to be matched with the following priority condition 1 which is established with respect to the preceding chord designated by the depressed key chord data DPCHD.

(i) Priority Condition 1: This condition where the chord type TYPE varies from 7th or 7th(SUS4) to Maj and the chord root ROOT descends by every semitone in one tone interval or seven tone intervals. In short, the chord progression matches with the falling or concluding phrase indicative of the cadence chords in this priority condition 1.

If the buffer register 83*c* stores the chord to be matched with the above priority condition 1 (hereinafter, referred simply to as a priority-1 chord), the judgement result of step 505 turns to "YES" so that the processing proceeds to step 506. In step 506, the data ROOT, TYPE of the chord data concerning this priority-1 chord are set and stored as the depressed key chord data DPCHD. Then, similar to the foregoing steps 407 to 409 of the first chord detecting routine, the modulo-8 arithmetic is operated such that "1" is added to the current table address CTAD in step 507; the data ROOT, TYPE of DPCHD and the chord tension level CTENL are written at the address of the chord table 83*g* designated by CTAD; and the depressed key flag in the buffer register 83*b* corresponding to the data DPCHD is stored at the address of the table 83*f* designated by CTAD in step 509. Incidentally, in the process of step 508, the key has been already set. Therefore, the modulo-12 arithmetic is operated such that the key data MKD is substracted from the root note data ROOT of DPCHD. Thus, the chord type TYPE of DPCHD and the chord data which is expressed by the degree based on the C key are obtained from this operation. In response to this chord data, the CPU 82 refers to the chord tension table 91*b* (see FIG. 3C), from which the chord tension level CTENL is to be read. This CTENL is then written into the chord table 83*g*. As a result, the chord based on the cadence theory of the music is selectively determined prior to other chords. After executing the process of step 509, the processing proceeds to step 510 wherein the priority-1 chord flag PCDF is varied at "1". Then, the processing proceeds to step 511.

On the other hand, when it is judged that the buffer register 83*c* does not store the priority-1 chord, the judgement result of step 505 turns to "NO" so that the processing directly proceeds to step 511 from step 505. In this case, the priority chord flag PCDF is set at "0".

In step 511, with respect to the preceding chords indicated by the depressed key chord data DPCHD, the chord to be matched with the following priority condition 2 or 3 is extracted from the chords stored in the buffer register 83*c*.

(ii) Priority Condition 2: This priority condition 2 is the condition where the chord is transferred from the second chord group to the third or fourth chord group in the chord tension table 91*b* (see FIG. 3C).

(iii) Priority Condition 3: This priority condition 3 is the condition where the chord is transferred from the fifth chord group to the sixth or seventh chord group in the chord tension table 91*b*.

Incidentally, in order to execute the above-mentioned chord extraction, the CPU 82 refers to the chord tension table 91*b* based on the depressed key chord data DPCHD, the chord data in the table 83*c* and the key data MKD. Then, the extracted chord data is to be temporarily stored.

Next, in step 512, it is judged whether or not any extracted chord data is existed. If the extracted chord data is existed, the judgement result of step 512 turns to "YES" so that the processing enters into processes of steps 513 to 520. Then, the processing proceeds to step 521 shown in FIG. 9B. If not, the judgement result of step 512 turns to "NO" so that the processing directly proceeds to step 521.

In step 513, it is judged whether or not the extracted chord data include the chord data to be matched with the following priority condition 4 with respect to the preceding chord designated by DPCHD.

(iv) Priority Condition 4: In this priority condition 4, the current chord included in the extracted chords is whole 4-degree above the preceding chord.

In this case, the modulo-12 arithmetic is operated such that the root note ROOT of the extracted chord data is subtracted from that of the data DPCHD. Then, it is judged whether or not this subtraction result equals to "5". If the extracted chord data include the chord data to be matched with the priority condition 4 (hereinafter, simply referred to as a priority-4 chord data), the judgement result of step 513 turns to "YES" so that the processing proceeds to step 514. In step 514, the data ROOT and TYPE of this priority-4 chord data are set as the depressed key chord data DPCHD. If the extracted chord data do not include the priority-4 chord data, the judgement result of step 513 turns to "NO" so that the processing proceeds to step 515. In step 515, one of the extracted chord data is selected in accordance with the predetermined condition. For example, the firstly extracted chord data is selected. Then, the data ROOT, TYPE of this selected chord data are set as DPCHD.

After executing the processes of steps 514, 515, the processing proceeds to step 516 wherein it is judged whether or not the priority chord flag PCDF is at "1". In this case, since the priority chord flag PCDF is set at "1" in step 510, the judgement result of step 516 turns to "YES". Then, the processing proceeds to steps 517, 518 in which the processes similar to those of the foregoing steps 508, 509 are to be executed. More specifically, in step 517, the data ROOT, TYPE of DPCHD and the chord tension level CTENL are written at the address of the chord table 83*g* designated by the current table address CTAD. In next step 518, the depressed key flag in the buffer register 83*b* corresponding to DPCHD is stored at the address of the table 83*f* designated by CTAD. In this case, the current table address CTAD is not incremented, which is made in the foregoing step 510. Therefore, the data which are in the tables 83*g*, 83*f* by the processes of steps 508, 509 are rewritten by the processes of steps 517, 518.

Meanwhile, if the foregoing processes of steps 506 to 510 are not executed, the PCDF is not at "1" so that the judgement result of step 516 turns to "NO". Then, the processing proceeds to step 519 from step 516, wherein the PCDF is set at "1". In next step 520 (whose process is similar to that of the foregoing step 507), the CTAD is incremented by "1". Thereafter, the processes of steps 517, 518 are executed. As a result, the data ROOT, TYPE, CTENL and depressed key flag corresponding to the DPCHD are written at the addresses of the tables 83*g*, 83*f* which are incremented by "1" as compared to the addresses at which these data are originally written. Due to the processes of steps 511 to 518, 519, 520, the chord adequate to the chord progression of the music is selectively determining prior to other chords.

After executing the process of step 518, the processing proceeds to step 521 shown in FIG. 9B wherein it is judged whether or not the determined key is the minor key. In case of the minor key, the key data MKD indicates the minor key so that the judgement result of step 521 is "YES". Then, the processing enters into a minor key priority routine consisting of steps 522 to 534. Thereafter, the processing proceeds to step 535 shown in FIG. 9C. On the other hand, in case of the major key, the judgement result of step 521 is "NO" so that the processing directly proceeds to step 535 from step 521.

Next, description will be given with respect to this minor key priority routine. In step 522, it is judged whether or not the primary cadence chord flag PCCF is at "0". If the PCCF is at "1" in the state where the cadence chord has been previously selected, the judgement result of step 522 turns to "YES" so that the processing sequentially proceeds to steps 523, 524. In steps 523, 524, it is respectively judged whether or not the buffer register 83*c* stores the cadence chord or the primary chord. These judging processes of steps 523, 524 are executed by referring to the primary/cadence chord table 91*c* based on the chord data expressed by the degree and the data TYPE of each chord data, wherein this chord data is obtained by executing the modulo-12 arithmetic such that the key data MKD is subtracted from the ROOT of each chord data stored in the buffer register 83*c*. If the buffer register 83*c* stores the primary chord, the judgement result of step 523 turns to "YES" so that the processing proceeds to step 525 wherein the PCCF is set at "0" indicative of the primary chord. Then, in step 526, the data ROOT, TYPE of the chord data to be matched with the foregoing condition are set as the DPCHD. Meanwhile, if the buffer register 83*c* does not store the primary chord but the cadence chord, the judgement result of step 523 turns to "NO" but the judgement result of next step 524 turns to "YES". Then, the processing proceeds to step 527 wherein the PCCF is set at "1" indicative of the cadence chord. Thereafter, the process of step 526 is executed. On the other hand, the buffer register 83*c* does not store the primary chord and cadence chord at all, the processing directly proceeds to step 535 shown in FIG. 9C from step 524.

Meanwhile, if the PCCF is at "0" in the state where the primary chord has been previously selected, the judgement result of step 522 turns to "NO" so that the processing proceeds to steps 528, 529 wherein it is judged whether or not the buffer register 83*c* stores the cadence chord or the primary chord. These judging processes of steps 528, 529 are executed as similar to those of steps 524, 523. More specifically, when the buffer register 83*c* stores the cadence chord, the judgement result of step 528 turns to "YES" so that the PCCF is set at "1" indicative of the cadence chord in step 527. Then, in step 526, the data ROOT, TYPE of the chord data to be matched with the foregoing condition is set as the DPCHD. If the buffer register 83*c* does not store the cadence chord but the primary chord, the judgement result of step 528 is "NO" but the judgement result of step 529 is "YES". In this case, the PCCF is set at "0" indicative of the primary chord in step 525. Then, the process of step 526 is to be executed. On the other hand, if the buffer register 83*c* does not store the primary chord and the cadence chord at all, the judgement results of steps 528, 529 both turn to "NO" so that the processing proceeds to step 535 shown in FIG. 9C.

After completing the process of step 526, the CPU 82 starts to execute processes of steps 530 to 532 which are similar to those of steps 516 to 518 shown in FIG. 9A. More specifically, if the priority chord flag PCDF has been previously set at "1", the data ROOT, TYPE, CTENL and depressed key flag corresponding to the newest data DPCHD which has been already stored in the tables 83*g*, 83*f* are respectively renewed. On the other hand, if the PCDF has not been set at "1" yet, the CTAD is incremented by "1", and then the data ROOT, TYPE and depressed key flag corresponding to the DPCHD are newly written at the addresses of the tables 83*g*, 83*f* designated by the incremented CTAD. Due to the processes of steps 522 to 534, the primary chord and cadence chord are controlled to be alternatively selected. Thus, the chord adequate to the chord progression of the music in the minor key is selectively determined prior to other chords.

After executing processes of steps 521, 524, 529, 532, the processing proceeds to step 535 shown in FIG. 9C wherein it is judged whether or not the chord priority flag PCDF is at "1". If the adequate chord has been already selected prior to other chords as described before and the PCDF is at "1", the judgement result of step 535 turns to "YES" so that the processing directly proceeds to step 542 from step 535. In step 542, the execution of the second chord detecting routine is terminated. If not, the judgement result of step 535 turns to "NO" so that the processing proceeds to step 536 wherein the chord tension level CTENL is written by each chord stored in the buffer register 83*c*. In such writing of the chord tension level CTENL, the modulo-12 arithmetic is operated such that the tone pitch indicated by the key data MKD is subtracted from the data ROOT of each chord data, so that the ROOT is expressed by the degree. Thereafter, by referring to the chord tension table 91*b* based on this ROOT and the data TYPE of the DPCHD, the chord tension level CTENL is read from this table 91*b* and then added to the chord data in the buffer register 83*c*. However, this table 91*b* does not store the chord tension levels CTENL concerning the Aug chord and Dim chord. This prevents the CTENL concerning the Aug chord and Dim chord from being written into the buffer register 83*c*.

After completing the above process of step 536, the processing proceeds to step 537 wherein it is judged whether or not the buffer register 83*c* stores the chord data to be matched with the following chord tension transfer condition.

(v) Chord Tension Transfer Condition: According to this chord tension transfer condition, the chord tension level CTENL is controlled to gradually rises up (in a level range between "0" and "+3"), while CTENL is controlled to rapidly falls down (in a level less than "−3"). Thus, the CTENL varies in a manner of a sawtooth waveform.

In this judging process of step 537, the process similar to that of the foregoing step 536 is executed. More specifically, by referring to the chord tension table 91*b* based on the key data MKD and the data ROOT, TYPE of the chord indicated by the DPCHD, the chord tension level CTENL* of the preceding chord. Then, this preceding chord tension level CTENL* is compared to the chord tension level CTENL for each chord data stored in the buffer register 83*c*. Thereafter, the CPU 82 searches the chord tension level CTENL to be matched with the following inequalities:

$$0 < \text{CTENL} - \text{CTENL}^* < +3 \text{ or}$$
$$\text{CTENL} - \text{CTENL}^* < -3$$

If the chord to be matched with the chord tension level transfer condition (hereinafter, simply referred to as a transfer chord) is found out, the judgement result of step 537 turns to "YES". Then, the processing enters into processes of steps 538 to 541 which are similar to those of the foregoing steps 526, 534, 531 and 532. More specifically, the data ROOT, TYPE of this transfer chord are set as the DPCHD. Then, the current table address CTAD is incremented by "1". Further, the data ROOT, TYPE, CTENL and depressed key flag corresponding to the DPCHD are written at the addresses of the tables 83*g*, 83*f* designated by the incremented address CTAD. After completing the process of step 541, the processing proceeds to step 542, whereby the execution of the second chord detecting routine is terminated. Due to the processes of steps 536 to 541, the adequate chord is determined in accordance with the chord tension level line indicating the chord progression.

On the other hand, if the buffer register 83*c* does not store the foregoing transfer chord, the judgement result of step 537 turns to "NO" so that the processing proceeds to step 543. Then, processes of steps 543 to 551 are to be executed. These processes of steps 543 to 551 are similar to those of the foregoing steps 402 to 409 in the first chord detecting routine shown in FIG. 8, except for step 549. This process of step 549 is similar to that of step 531 shown in FIG. 9B wherein the CTENL is further written into the chord table 83*g* in addition to the ROOT, TYPE. As a result, among the chord data stored in the buffer register 83*c*, the chord data whose chord tension note number TENSU and smallest tension note number LTNO are the small is to be determined as the designated chord.

(5) KEY JUDGING ROUTINE

Figure 10A:
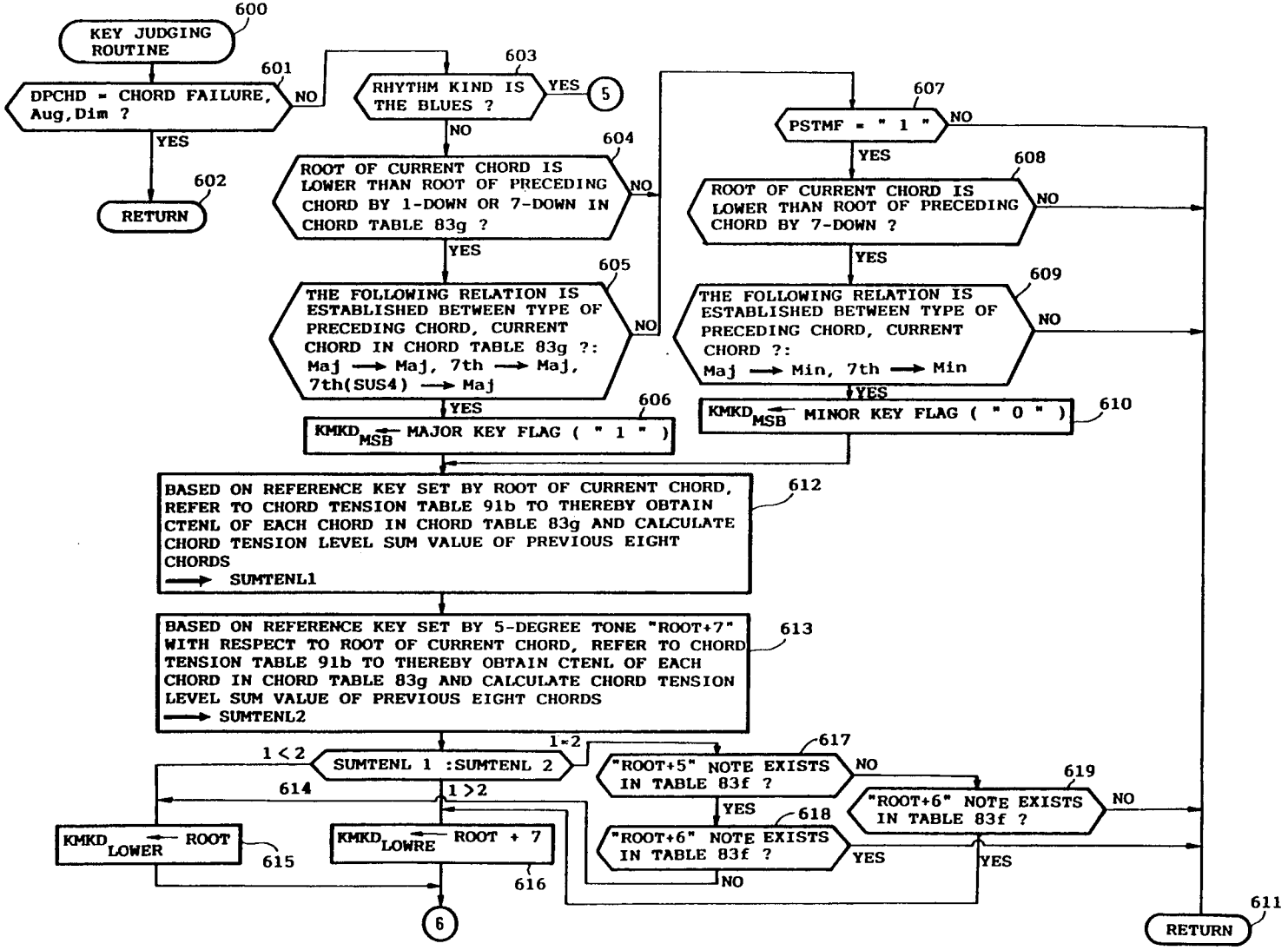
Figure 10B:
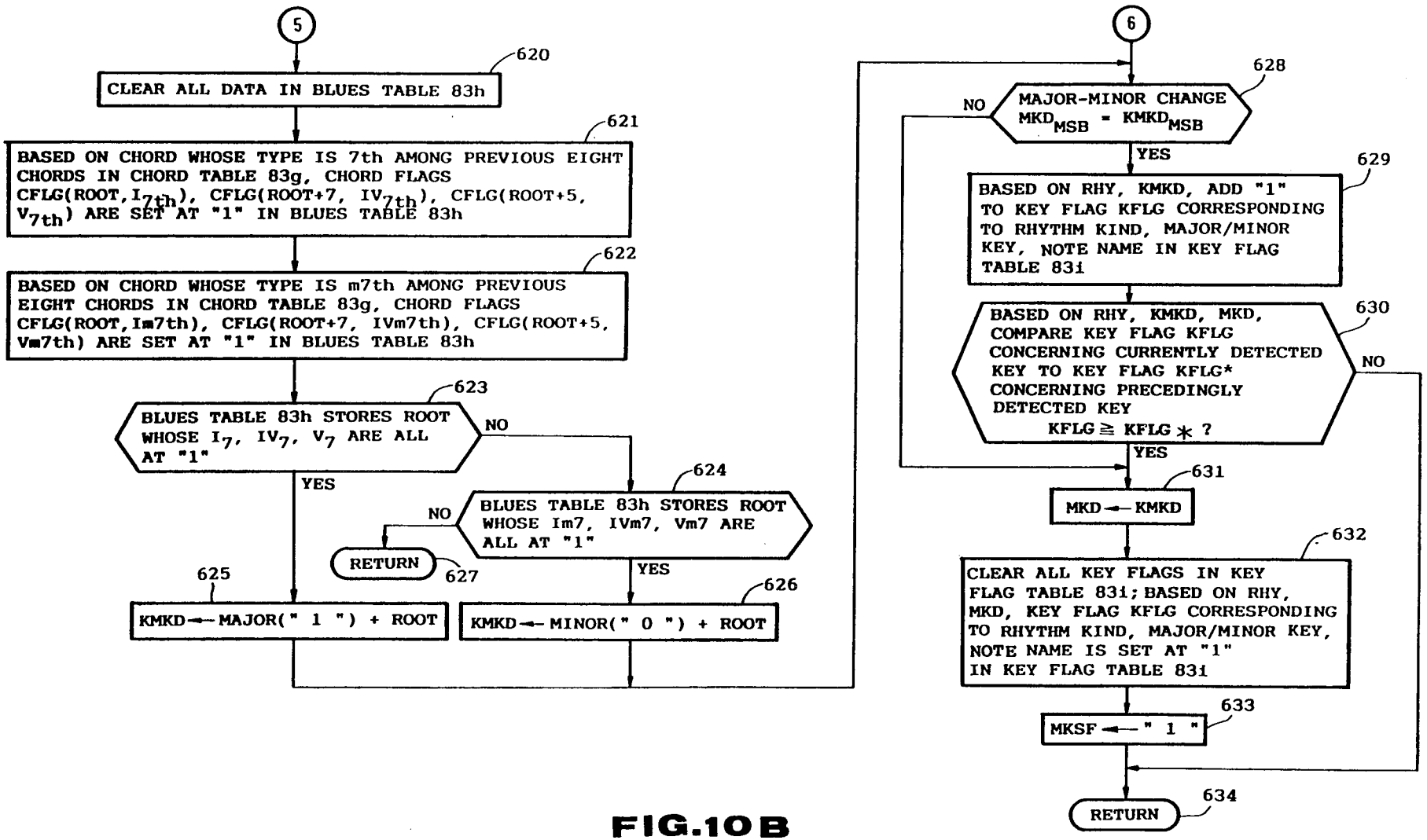

Next, description will be given with respect to the key judging routine as shown in FIGS. 10A and 10B. This routine is started from step 600 shown in FIG. 10A. In next step 601, if the current chord, i.e., the depressed key chord data DPCHD indicates the the failure chord such as the Aug chord and Dim chord, the judgement result of step 601 turns to "YES" so that the processing proceeds to step 602, whereby the execution of this key judging routine is terminated. In short, this key judging routine is not substantially executed in case of the chord failure data.

In the meantime, if the current chord does not indicate the failure chord (i.e., Aug chord and Dim chord), the processing proceeds to step 603 wherein it is judged based on the rhythm kind data RHY whether or not the selected rhythm designates the blues. This judging process of step 603 must be executed because the key judging condition in case of the blues is quite different from that in case of the music other than the blues.

First, description will be given with respect to the case where the selected rhythm designates the music other than the blues. In this case, the judgement result of step 603 is "NO" so that the processing enters into a major key judgement activating routine consisting of steps 604 and 605. In step 604, it is judged whether the ROOT of current chord descends from that of preceding chord by the semitones of one tone or seven tones. In this step 604, the ROOT of the DPCHD is compared to the ROOT of the chord data stored at the preceding address of the chord table 83*g* which is prior to the current address designated by the CTAD. For example, when the ROOT is varied from the G note to the C note or from the $D^b$ note to the C note, the judgement result of step 604 turns to "YES" so that the processing proceeds to step 605. This step 605 judges the change of the TYPE between the preceding chord and current chord: e.g., from Maj chord to Maj chord; from 7th chord to Maj chord; or from 7th(SUS4) chord to Maj chord. In this case, the TYPE of the DPCHD is compared to that of the preceding chord data stored at the preceding address of the chord table 83*g*. For example, in the case where the chord is varied from $G_{Maj}$ to $C_{Maj}$ or from $G_{7th}$ to $C_{Maj}$, the judgement result of step 605 turns to "YES" so that the processing proceeds to step 606 wherein "1" indicative of the major key is set to the MSB of the temporary key data.

Meanwhile, if the ROOT or TYPE is not in the above-mentioned condition of step 604 or 605, the judgement result of step 604 or 605 turns to "NO" so that the processing proceeds to a minor key judgement activating routine consisting of steps 607 to 609. In step 607, it is judged whether or not the performance start minor flag PSTMF is at "1", which represents one condition for determining the minor key, i.e., "whether the chord at the performance start timing is the Min chord or m7th chord". If the PSTMF is at "0", the present situation does not match with this condition so that the judgement result of step 607 turns to "NO". Then, the processing directly proceeds to step 611, whereby the execution of the key judging routine is terminated. On the other hand, if the PSTMF is at "1", the judgement result of step 607 turns to "YES" so that the processing proceeds to step 608. In step 608, it is judged whether or not the ROOT of the current chord descends from that of the preceding chord by the semitones in seven tones. In this judging process of step 608, the ROOT of the DPCHD is compared to that of the chord data stored at the preceding address of the chord table 83*g*. For example, when the ROOT is varied from the G note to the C note, the judgement result of step 608 turns to "YES" so that the processing proceeds to step 609. In step 609, the change of the TYPE between the preceding chord and current chord is judged: e.g., from Maj chord to Min chord; or from 7th chord to Min chord. If the chord is varied from $G_{Maj}$ to $C_{Min}$ or from $G_{7th}$ to $C_{Min}$, the judgement result of step 609 turns to "YES". Then, in step 610, "0" indicative of the minor key is set to the MSB of the temporary key data KMKD.

In the meantime, if the ROOT or TYPE is not in the above-mentioned condition of step 608 or 609, the judgement result of step 608 or 609 turns to "NO" so that the processing proceeds to step 611, whereby the execution of the key judging routine is terminated.

In the case where the processing proceeds to step 606 from steps 604, 605 or the processing proceeds to step 610 from steps 607 to 609, it can be predicted that the key corresponding to the ROOT of the DPCHD or another key which is higher than this ROOT by 5-degree will be determined. In the case where the ROOT is the C note, the C key or G key will be determined, for example. Then, in order to select one of these two keys, the following processes of steps 612 to 619 will be executed. In step 612, each chord data in the chord table 83*g* is expressed by degree based on the reference key corresponding to the ROOT of the DPCHD by operating the subtraction of "(ROOT of each chord data)—(ROOT of DPCHD)". Then, based on such chord expressed by degree, the CPU 82 refers to the chord tension table 91*b* to thereby obtain previous eight chord tension levels CTENL. The sum of these previous eight chord tension levels CTENL is calculated as the first tension level sum value SUMTENL1. Next, the calculating process similar to that of step 612 is executed in step 613. More specifically, based on the reference key corresponding to (ROOT+7) which is higher than the ROOT of the DPCHD by 5-degree, the sum of the previous eight chord tension levels CTENL is calculated as the second tension level sum value SUMTENL2.

After completing the calculating processes of steps 612, 613, the processing proceeds to step 614 wherein the SUMTENL1 is compared to the SUMTENL2. In case of SUMTENL1<SUMTENL2, it is judged that the temporary key is indicated by the ROOT of the DPCHD. For example, if the ROOT is the C note, C key is judged. In this case, the processing proceeds to step 615 wherein the ROOT is stored at the lower bits of the temporary key data KMKD. In contrast, in case of SUMTENL1>SUMTENL2, it is judged that the temporary key is indicated by (ROOT+7) which is higher than the ROOT by 5-degree. For example, if the ROOT is the C note, G key is judged. Then, the processing proceeds to step 616 wherein (ROOT+7) is stored at the lower bits of the KMKD.

Further, in case of SUMTENL1=SUMTENL2, the processing enters into processes of steps 617 to 619. In these steps 617 to 619, it is judged whether or not the constituent notes in the previous eight chords include the IV-degree note of the ROOT (e.g., the F note in case of the C note as the ROOT) or the IV#-degree note of the ROOT (e.g., the F# note in case of the C note as the ROOT). More specifically, the CPU 82 refers the the table 83*f* based on (ROOT+5) in step 617; and the CPU 82 also refers to the table 83*f* based on (ROOT+6) in steps 618, 619. If the table 83*f* stores the IV-degree note but does not store the IV#-degree note, the judgement result of step 617 turns to "YES" but the judgement result of step 618 turns to "NO". This means it is judged that the temporary key is indicated by the ROOT of the DPCHD. Then, the processing proceeds to step 615. On the other hand, if the table 83*f* stores the IV#-degree note but does not store the IV-degree note, the judgement result of step 617 turns to "NO" but the judgement result of step 619 turns to "YES". This means it is judged that the temporary key is indicated by the root note (ROOT+7) of the DPCHD. Then, the processing proceeds to step 616. Further, if the table 83*f* does not store both of the IV-degree note and IV#-degree note, the judgement results of steps 617, 618 are "YES" or the judgement results of steps 617, 619 are "NO". Then, the processing proceeds to step 611, by which the execution of the key judging routine is terminated.

As described heretofore, if the selected rhythm designates the music other than the blues, the temporary key is judged by the processes of steps 604 to 619. By the processes of steps 606, 610, 615, 616, the temporary key data KMKD is set. Then, the processing proceeds to step 628 shown in FIG. 10B.

In contrast, if the selected rhythm designates the blues, the judgement result of step 603 turns to "YES" so that the processing proceeds to step 620 shown in FIG. 10B. In step 620, the all data in the blues table 83*h* (see FIG. 2G) are cleared. In step 621, the chord whose type is the 7th is extracted from the previous eight chords in the chord table 83*g* (see FIG. 2F). In addition, by every ROOT of the extracted chord, "1" is set to the chord flag DFLG at each of the storing positions (ROOT, $I_{7th}$), (ROOT+7, $IV_{7th}$) and (ROOT, $V_{7th}$) of the blues table 83*h*. In this case, it is assumed that the $I_{7th}$ chord whose key corresponds to the ROOT may be either the $IV_{7th}$ chord whose key corresponds to (ROOT+7) or the $V_{7th}$ chord whose key corresponds to (ROOT+5). Next, in step 622, the chord whose type is the m7th is extracted from the previous eight chords in the chord table 83*g*. In addition, by every ROOT of the extracted chord, "1" is set to the chord flag DFLG at each of the storing positions (ROOT, $I_{m7th}$), (ROOT+7, $IV_{m7th}$) and (ROOT+5, $V_{m7th}$) of the blues table 83*h*. In this case, it is assumed that the $I_{m7th}$ chord whose key corresponds to the ROOT may be either the $IV_{m7th}$ chord whose key corresponds to (ROOT+7) or the $V_{m7th}$ chord whose key corresponds to (ROOT+5).

After completing the processes of steps 621, 622, the processing proceeds to step 623 wherein it is judged whether or not the blues table 83*h* stores the ROOT whose chord flags DFLG concerning the chords $I_{7th}$, $IV_{7th}$ and $V_{7th}$ are all at "1". Then, in step 624, it is judged whether or not the blues table 83*h* stores the ROOT whose chord flags DFLG concerning the chords $I_{m7th}$, $IV_{m7th}$ and $V_{m7th}$ are all at "1". These judgements are made because the following blues conditions 1 and 2 are used for judging the key in case of the blues.

(i) Blues Condition 1: This is the condition where the current key is judged as the major key when all of the chords $I_{7th}$, $IV_{7th}$, $V_{7th}$ emerge in the previous eight chords.

(ii) Blues Condition 2: This is the condition where the current key is judged as the minor key when all of the chords $I_{m7th}$, $IV_{m7th}$, $V_{m7th}$ emerge in the previous eight chords.

If the above blues condition 1 is established, the judgement result of step 623 turns to "YES" so that the processing proceeds to step 625 wherein "1" indicative of the major key is set at the MSB of the temporary key data KMKD. Then, the lower (or rightmost) bits of the KMKD are set as the corresponding ROOT. On the other hand, if the blues condition 2 is established, the judgement result of step 623 turns to "NO" but the judgement result of step 624 turns to "YES" so that the processing proceeds to step 626 wherein "0" indicative of the minor key is set at the MSB of the temporary key data KMKD. Then, the lower bits of the KMKD are set as the corresponding ROOT. Further, when both of the blues conditions 1 and 2 are not established, the judgement results of steps 623 and 624 both turn to "NO" so that the execution of the key judging routine is terminated in step 627.

As described above, if the selected rhythm designates the blues, the temporary key is determined by the processes of steps 620 to 624. Then, by the processes of steps 625, 626, the temporary key data KMKD is set. Thereafter, the processing proceeds to step 628.

In step 628, the key data MKD is compared to the MSB of the temporary key data KMKD. Then, it is judged whether or not both of the precedingly determined key and the temporary key to be set designates the same key kind (i.e., major or minor key). If so, the judgement result of step 628 turns to "YES" so that the processing proceeds to step 629. In step 629, based on the rhythm kind data RHY (indicating the blues or not) and the temporary key data KMKD, the storing position of the key flag table 83*i* (see FIG. 2H) corresponding to the rhythm kind, key kind and note name is to be designated. Then, "1" is added to the key flag KFLG at the designated storing position. Herein, the key flag KFLG varies from "0" to "3". So, if the key flag KFLG is at "3", such addition is not made. Next, in step 630, the CPU 82 refers to the key flag table 83*i* again based on the rhythm kind data RHY and temporary key data KMKD. Then, the key flag KFLG concerning the currently detected key (i.e., temporary key data KMKD) is compared to the key flag KFLG* concerning the precedingly determined key (i.e., key data MKD). If the key flag KFLG* is larger than the key flag KFLG, the judgement result of step 630 turns to "NO" so that the execution of the key judging routine is terminated in step 634. In this case, the precedingly determined key is not varied. This prevents the mistake from being made on the key judgement. In other words, if the key is varied based on the relatively small amount of information, the key judgement (i.e., the modulation judgement) must be incorrect. Therefore, such incorrectness is prevented from being occurred by this judging process of step 630.

Meanwhile, if the addition operation executed on the key flag KFLG in step 629 results that the current key flag KFLG becomes larger than the preceding key flag KFLG*, the judgement result of step 630 turns to "YES" so that the key data MKD is set equal to the temporary key data KMKD in step 631. Thus, the key of the present electronic musical instrument is determined at first or varied. In next step 632, all data in the key flag table 83*i* are cleared so that the key flag table 83*i* is initialized. In addition, "1" is set to the key flag KFLG (which is added with "1" in the foregoing step 629) at the storing position of the key flag table 83*i* corresponding to the rhythm kind, key kind and note name based on the rhythm kind data RHY and key data MKD. In step 633, the key setting flag MKSF is set at "1". Thereafter, the execution of this key judging routine is terminated in step 634.

In the case where the temporary key (i.e., KMKD) to be set is different from the precedingly determined key (i.e., MKD) in the key kind (i.e., major or minor key), the judgement result of step 628 turns to "NO" so that the processing proceeds to step 631. Thus, the processing enters into the processes of steps 631 to 633. In this case, the processes of steps 629 and 630 (i.e., the judgement process concerning the key flag KFLG) are omitted, and then the key is varied immediately. As a result, the modulation from the major key to the minor key and the modulation from the minor key to the major key are made prior to other modulations.

(6) MODE DETERMINING ROUTINE

Figure 11:
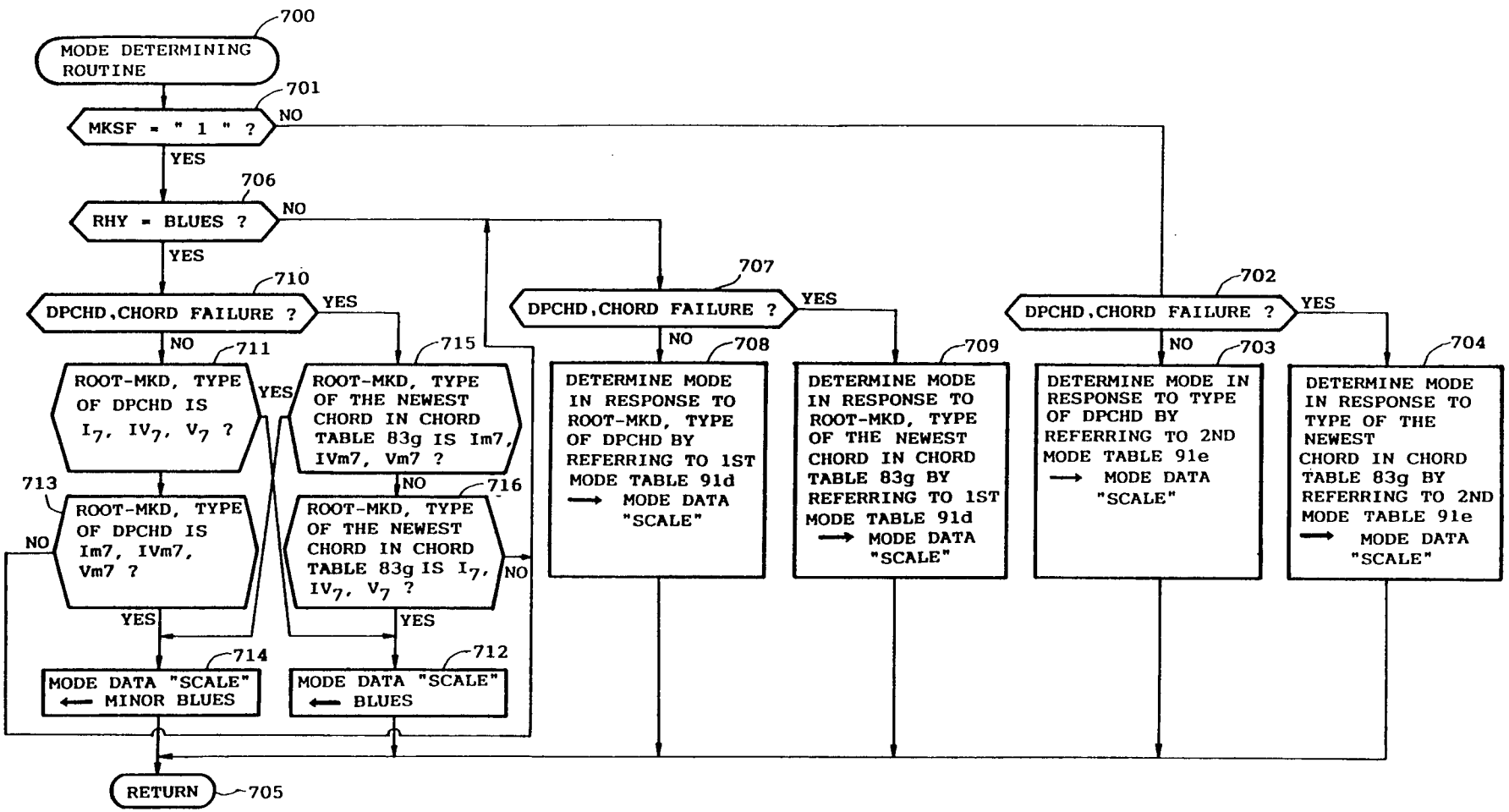

Next, description will be given with respect to the mode determining routine by referring to the flowchart shown in FIG. 11. The methods of determining the mode are different in the following three cases:

(i) first case where the key has not been determined yet;

(ii) second case where the key has been already determined and the selected rhythm does not designate the blues; and (iii) third case where the key has been already determined and the selected rhythm designates the blues. So, the description of this mode determining routine is given with respect to each case.

(i) First Case: In this case where the key has not be determined yet, the key setting flag MKSF is set at "0". So, after the execution of the mode determining routine in step 700, the judgement result of step 701 turns to "NO" because the MKSF is not at "1". In step 702, it is judged whether or not the DPCHD corresponding to the current chord designates the chord failure. If the DPCHD does not designate the chord failure, the judgement result of step 702 turns to "NO" so that the processing proceeds to step 703 wherein the CPU 82 refers to the second mode table 91*e* (see FIG. 3F) based on the DPCHD. Then, the mode name (e.g., Ionian in case of Maj chord or Dorian in case of Min chord) corresponding to the TYPE of the DPCHD is read from the table 91*e* and set as the mode data SCALE. Thereafter, the processing proceeds to step 705, whereby the execution of the mode determining routine is terminated.

Meanwhile, if the depressed key chord data DPCHD indicates the chord failure, the judgement result of step 702 turns to "YES" so that the processing proceeds to step 704 wherein the CPU 82 refers to the second mode table 91*e* based on the precedingly detected chord, i.e., the chord data in the chord table 83*g* indicated by the current table address CTAD. Then, similar to the process of step 703, the mode data SCALE is set. Thereafter, the execution of the mode determining routine is terminated in step 705. Incidentally, when the chord table 83*g* does not store any chord data at all just after the performance start timing, the mode data is not read from the chord table 83*g*, so the mode data SCALE is not set.

Due to the above-mentioned processes of steps 702 to 704, it is possible to determine the reasonable mode, however, which may not be the correct chord. In other words, such mode determining method according to steps 702 to 704 may not be perfect but reasonable.

(ii) Second Case: In this case where the key has been already determined and the selected rhythm kind does not designate the blues, the key setting flag MKSF has been already at "1" and the rhythm kind data RHY does not designate the blues. Therefore, the judgement result of step 701 is "YES", but the judgement result of step 706 is "NO". So, the processing proceeds to step 707 wherein the judging process similar to that of the foregoing step 702 is executed. More specifically, it is judge whether or not the DPCHD indicates the chord failure. If the DPCHD does not indicate the chord failure, the judgement result of step 707 turns to "NO" so that the processing proceeds to step 708 wherein the CPU 82 refers to the first mode table 91*d* (see FIG. 3E) based on the chord data corresponding to the DPCHD expressed by degree. Then, the mode name is read from the table 91*d* and set as the mode data SCALE. More specifically, the note name data of the key data MKD is subtracted from the ROOT of the DPCHD. Based on such subtraction result and the TYPE of the DPCHD, the CPU 82 refers to the first mode table 91*d* to thereby read the mode name (e.g., Ionian in case of $I_{Maj}$, Dorian in case of $II_{m7th}$). Incidentally, if the chord data expressed by degree belongs to the second group etc. after the first group (see the chord tension table 91*b* shown in FIG. 3C), the desirable mode name is read by each group. For example, in case of the chord in the fourth group, the mode name such as Mixolydian is to be read. Thereafter, the execution of the mode determining routine is terminated in step 705.

In the meantime, if the DPCHD designates the chord failure, the judgement result of step 707 turns to "YES" so that the processing proceeds to step 709. In step 709, the CPU 82 refers to the first mode table 91*d* based on the precedingly detected chord, i.e., the chord data expressed by degree which is stored at the address indicated by the CTAD in the chord table 83*g*. Then, similar to the foregoing step 708, the mode data SCALE is set. Thereafter, the execution of the mode determining routine is terminated in step 705.

Due to the above-mentioned processes of steps 707 to 709, it is possible to determine the musically adequate mode.

(iii) Third Case: In this case where the key setting flag MKSF has been already at "1" and the rhythm kind data RHY designates the blues, the judgement results of steps 701 and 706 both turn to "YES" so that the processing proceeds to step 710 wherein, similar to the foregoing steps 702 and 707, it is judged whether or not the DPCHD designates the chord failure. If the DPCHD does not designate the chord failure, the judgement result of step 710 turns to "NO" so that the processing proceeds to step 711 wherein it is judged whether or not the chord data expressed by degree corresponding to the DPCHD indicates any one of the chords $I_{7th}$, $IV_{7th}$ and $V_{7th}$. More specifically, the note name data of the key data MKD is subtracted from the ROOT of the DPCHD. Then, based on such subtraction result and the TYPE of the DPCHD, it is judged whether or not the chord data indicates any one of the chords $I_{7th}$, $IV_{7th}$ and $V_{7th}$. If the chord data indicates any of these three chords, the judgement result of step 711 turns to "YES" so that the processing proceeds to step 712 wherein the data indicative of the blues mode is set as the mode data SCALE. Then, the execution of the mode determining routine is terminated in step 705.

On the other hand, if the judgement result of step 711 is "NO", the processing proceeds to step 713 wherein it is judged whether or not the chord data expressed by degree corresponding to the DPCHD indicates any one of the chords $I_{m7th}$, $IV_{m7th}$ and $V_{m7th}$. More specifically, based on the TYPE of the DPCHD and the result obtained by subtracting the note name data of the key data MKD from the ROOT of the DPCHD, it is judged whether or not the chord data indicates any one of the chords $I_{m7th}$, $IV_{m7th}$ and $V_{m7th}$. If the chord data expressed by degree indicates any one of these three chords, the judgement result of step 713 turns to "YES" so that the data indicative of the minor blues mode is set as the mode data SCALE in step 714. Thereafter, the execution of the mode determining routine is terminated in step 705.

Further, if the chord data expressed by degree corresponding to the DPCHD does not designate any one of the chords $I_{7th}$, $IV_{7th}$, $V_{7th}$, $I_{m7th}$, $IV_{m7th}$, $V_{m7th}$ so that the judgement results of steps 711, 713 are "NO", the processing proceeds to step 707 so that the mode will be determined by the processes of steps 707 to 709.

Meanwhile, if the depressed key chord data DPCHD designates the chord failure, the judgement result of step 710 turns to "YES" so that the processing proceeds to step 715. In step 715, it is judged whether or not the preceding chord (except for the Aug chord and Dim chord) indicates any one of the chords $I_{7th}$, $IV_{7th}$, $V_{7th}$, wherein the preceding chord is the newest chord expressed by degree stored at the address CTAD of the chord table 83g. In step 716, it is judged whether or not the above preceding chord indicates any one of the chords $I_{m7th}$, $IV_{m7th}$, $V_{m7th}$. Similar to the foregoing steps 711, 713, either one of the judgement results of steps 715, 716 turns to "YES" when the preceding chord indicates any one of the chords $I_{7th}$, $IV_{7th}$, $V_{7th}$ or the chords $I_{m7th}$, $IV_{m7th}$, $V_{m7th}$. Then, the processing proceeds to step 714 from step 715, wherein the minor blues mode is set to the mode data SCALE; while the processing proceeds to step 712 from step 716, wherein the blues mode is set to the mode data SCALE. Incidentally, if the preceding chord expressed by degree does not at all indicate any one of the above six chords, the judgement results of steps 715, 716 both turn to "NO" so that the processing proceeds to step 707, whereby the mode will be determined by the processes of step 707, to 709.

Due to these processes of steps 710 to 716, the adequate mode will be determined with respect to the blues. In addition, even if the blues mode or minor blues mode is determined, the adequate mode will be determined by the processes of steps 707 to 709.

Figure 12:
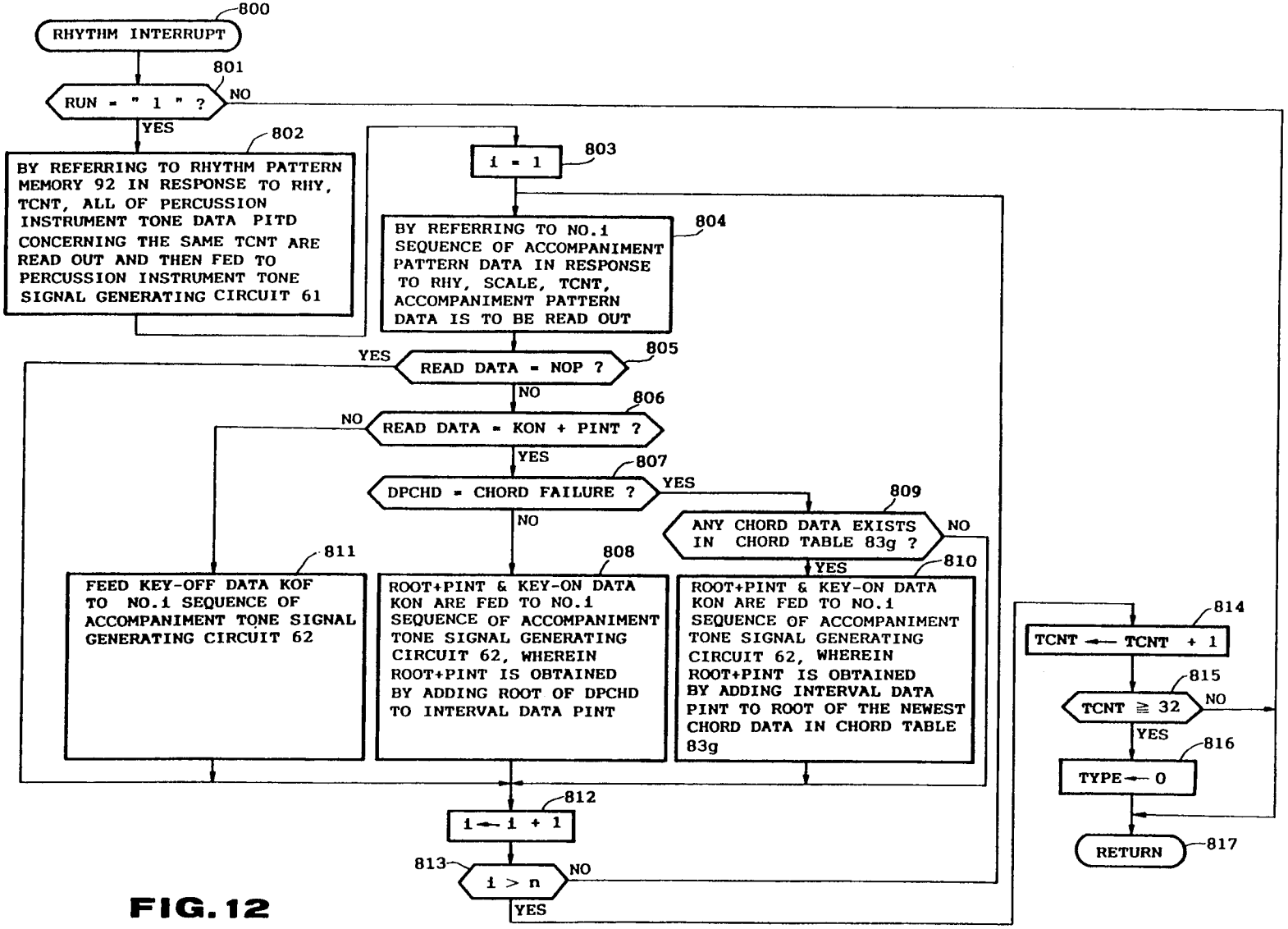

When the tempo oscillator 70 feeds the rhythm interrupt signal RINT to the CPU 82 which is executing the main program and its subroutines including the process of determining the chord, key, mode and other processes, the CPU 82 starts to execute the rhythm interrupt program as shown in FIG. 12 every time the RINT is fed thereto. Under execution of this rhythm interrupt program, the generations of the percussion instrument tone and accompaniment tone are to be controlled. Next, description will be given with respect to this rhythm interrupt program.

(7) Rhythm Interrupt Program

The execution of this rhythm interrupt program as shown in FIG. 12 is started from step 800, and then it is judged whether or not the rhythm run flag RUN is at "1" in step 801. If the RUN has been set at "1" by the foregoing step 125 in the main program shown in FIG. 5, the judgement result of step 801 is "YES" so that the processing enters into the following processes of steps 802 etc. wherein the generations of the percussion instrument tone and accompaniment tone are to be controlled. If the RUN is at "0", the processing directly proceeds to step 817, whereby the execution of the rhythm interrupt program is terminated without controlling the generations of the percussive instrument tone and accompaniment tone.

In step 802, the CPU 82 refers to the rhythm pattern memory 92 in response to the rhythm kind data RHY and tempo count data TCNT, whereby all of the percussion instrument data $PITD_1$, $PITD_2$ etc. corresponding to the selected rhythm indicated by the RHY and concerning the timings indicated by the TCNT are read from the rhythm pattern memory 92 and then fed to the percussion instrument tone signal generating circuit 61 via the bus 50. As a result, this circuit 61 generates the percussion instrument tone signal corresponding to the percussion instrument data $PITD_1$, $PITD_2$, which is then fed to the sound system 63. Thus, the sound system 63 sounds the percussion instrument tone. Incidentally, if the data read from the rhythm pattern memory 92 designates the data NOP, this data NOP is not fed to the percussion instrument tone signal generating circuit 61, whereby the generation of the percussion instrument tone is not controlled.

After completing the above process of step 802, the processing proceeds to step 803 wherein the variable i is set at "1". This variable i designates the number of series of accompaniment tones, i.e., the accompaniment memories 93-1 to 93-n, wherein it varies from "1" to "n". Next, in step 804, the CPU 82 refers to the No. i series (or No. i sequence) of accompaniment pattern memory 93-i in response to the rhythm kind data RHY, mode data SCALE and tempo count data TCNT. Then, the accompaniment pattern data corresponding to the selected rhythm, mode indicated by the RHY, SCALE and concerning the timings indicated by the TCNT is read from this accompaniment pattern memory 93-i. Thereafter, the processing proceeds to steps 805, 806 wherein the kind of this read accompaniment data is to be judged.

More specifically, if the read accompaniment data concerns the key-on data KON and interval data PINT, the judgement result of step 805 turns to "NO" and then the judgement result of step 806 turns to "YES" so that the processing proceeds to step 807. In step 807, it is judged whether or not the depressed key chord data DPCHD indicates the chord failure. If the DPCHD does not indicate the chord failure, the judgement result of step 807 turns to "NO" so that the processing proceeds to step 808. In step 808, the tone pitch data (ROOT+PINT) and key-on data KON are fed to the No.i sequence channel of the accompaniment tone signal generating circuit 62 via the bus 50, wherein the tone pitch data is obtained by adding the ROOT of the DPCHD to the PINT. As a result, the musical tone signal corresponding to the tone pitch data (ROOT+PINT) is generated in the No.i sequence channel of the accompaniment tone signal generating circuit 62, and then this musical tone signal is fed to the sound system 63. Thus, the sound system 63 sounds to the accompaniment tone corresponding to the No.i sequence among n accompaniment tones including the arpeggio tone, bass tone, chord etc. concerning the chord indicated by the DPCHD.

Meanwhile, if the DPCHD designates the chord failure so that the judgement result of step 807 is "NO", the processing proceeds to step 809 wherein it is judged whether or not the chord table 83g stores any chord data. If the chord table 83g stores the chord data, the judgement result of step 809 turns to "YES" so that the processing proceeds to step 810. In step 810, the newest chord data designated by the current table address CTAD is read from the chord table 83g. In addition, as similar to the foregoing step 808, this chord data is used for generating the accompaniment tone instead of the DPCHD. More specifically, the tone pitch data (ROOT+PINT) and key-on data KON are fed to the No.i sequence channel of the accompaniment tone signal generating circuit 62, wherein the tone pitch data is obtained by adding the ROOT of the above chord data to the interval data PINT read from the accompaniment pattern memory 93-i. Thus, even when the chord is not detected from the currently depressed keys, the adequate accompaniment tone can be obtained. Incidentally, in the case where the chord table 83g does not store any chord data just after the performance is started, the judgement result of step 809 turns to "NO" so that the processing directly proceeds to step 812, whereby the No.i sequence of accompaniment tone is not generated.

Now, referring back to the foregoing steps 805, 806, wherein if the accompaniment pattern data which is read from the accompaniment pattern memory 93-i by the process of step 804 indicates the key-off data KOF, the judgement results of steps 805, 806 both turn to "NO" so that the processing proceeds to step 811. In step 811, this key-off data KOF is fed to the No.i channel of the acompaniment tone signal generating circuit 62 via the bus 50. As a result, the No.i sequence of the accompaniment tone signal is attenuated based on the key-off data KOF in the No.i sequence channel of the accompaniment tone signal generating circuit 62. Thereafter, the generation of this accompaniment tone signal is terminated. As a result, the No.i sequence of the accompaniment tone generated from the sound system 63 gradually fades away. After completing the process of step 811, the processing proceeds to step 812.

Further, if the accompaniment pattern data which is read from the accompaniment pattern memory 93-i by the process of step 804 designates the data NOP, the judgement result of step 805 turns to "YES" so that the processing directly proceeds to step 812, whereby the processes concerning the accompaniment tone is not executed.

After completing the above-mentioned processes for No.i sequence, "1" is added to the variable i in step 812. If this variable i added with "1" is less than "n", the judgement result of step 813 is "NO" so that the processing returns to the foregoing step 804 again. Then, the CPU 82 executes the processes in the accompaniment tone generation control routine consisting of steps 804 to 811. Thus, the accompaniment tone generation control will be made on all of No.1 to No.n. sequences.

When the variable i becomes larger than "n" in the middle of the execution of the circulating processes consisting of steps 804 to 813, the judgement result of step 813 turns to "YES" so that the processing enters into the routine of renewing the tempo count data TCNT consisting of steps 814 to 817. More specifically, in step 814, "1" is added to the tempo count data TCNT so that the TCNT is incremented. In step 815, it is judged whether or not the incremented TCNT reaches "32". If the TCNT is less than "32", the judgement result of step 815 turns to "NO" so that the execution of this rhythm interrupt program is terminated in step 817. When the TCNT reaches "32", the judgement result of step 815 turns to "YES" so that the TNCN is initialized at "0" in step 816. Thereafter, the execution of the rhythm interrupt program is terminated in step 817.

As described heretofore, according to the present embodiment, the musically adequate chord, key and mode can be automatically detected in response to the key-depression of the keyboard 10. Based on this detection, the accompaniment tone corresponding to the adequate tone pitch is automatically generated. Therefore, it is possible to obtain the high-grade automatic accompaniment tone. In addition to the means of automatically determining the key in response to the chord performance information, the present embodiment provides the means of manually determining the key in response to the operation of the major key switch 22, minor key switch 23 and the keyboard 10. So, if the performer knows the key before starting the performance, it is possible to designate the key at the beginning of the performance. In this case, the above-mentioned means of automatically determining the key functions as the means of automatically determining the modulation.

[E] Modified Examples

The present embodiment can be modified as follows.

(1) In the case where the present embodiment judges the key when the selected rhythm kind designates the music other than the blues, it detects the specific chord progression to thereby determine the two kinds of temporary keys in steps 604 to 610 shown in FIG. 10A. Then, by comparing the two kinds of temporary keys to the tension level sum value of the previous eight chords, the present embodiment examines the harmonic degrees of the previous eight chords so that one key will be determined finally. If the key can not be determined by such examination, the present embodiment judges the matchings between all depressed key notes in the previous eight chords and the two kinds of temporary keys to thereby determine the key finally by steps 617 to 619. However, if reasonable reduction in the music quality can be allowed in order to reduce the cost for making the software etc., it is possible to omit steps 612 to 614, 617 to 619 so that the key corresponding to the ROOT will be determined by steps 604 to 610 only. Or, it is possible to omit either steps 612 to 614 or steps 617 to 619. Even such reduced software can sufficiently respond to the simple tune.

In addition, the present embodiment determines the key based on two continuous chord progressions by steps 604 to 610. Instead, it is possible to determine the key based on three or more continuous chord progressions. In this case, with respect to the newly detected chord, the previous three or more continuous chord data are read from the chord table 83*g* and then compared to the predetermined chord progression condition.

(2) In the present embodiment, it is necessary to depress all keyboard keys corresponding to all constituent notes in the chord. Instead, it is possible to designate the root note of the chord by designating the lowest-pitch-note or highest-pitch-note. In this case, the chord is detected in steps 106, 117 shown in FIG. 5A by the lowest-pitch-note (or highest-pitch-note) and other depressed key notes (such as the white key, black key, depressed key number etc.).

Further, it is possible todesignate the chord type only by any manually operable member other than the keyboard 10, or it is possible to designate the root note and type of the chord by any manually operable member other than the keyboard 10. In this case, the chord is judged in response to such manually operable member in steps 106, 117.

(3) In response to each rhythm kind and each kind of mode, the present embodiment provides plural series of accompaniment pattern memories 93-1, 93-2, . . . , 93-n each storing the interval data PINT corresponding to the semitone interval from the base note of each mode. Instead of the interval data PINT, it is possible to store the degree data (i.e., "1", "2", . . . in FIG. 3G) in the accompaniment pattern memory. With respect to each mode, common accompaniment pattern memory is used. In response to the plural rhythm kinds, plural accompaniment pattern memories are provided. In this case, it is necessary to additionally provide the degree-interval table by which the degree data is converted into the interval data PINT. Then, in step 804 shown in FIG. 12, the accompaniment pattern data is read out in response to the rhythm kind data RHY and tempo count data TCNT. If the read accompaniment pattern data is the degree data, this degree data is converted into the interval data PINT in response to the mode data SCALE in steps 808, 810. Thereafter, this PINT is added to the ROOT. For example, in the case where the degree data indicative of "3" is read from the accompaniment pattern memory and the mode data SCALE indicates the Ionian mode, the value of this degree data is converted into "4". On the other hand, if the mode data SCALE indicates the Dorian mode, the value of this degree data remains at "3" (see FIG. 3G). Thus, it is possible to reduce the storing capacity of the accompaniment pattern memory 93.

(4) The present embodiment detects the specific chord progression to thereby determine the key by each major or minor key when the rhythm kind designates the rhythm other than the blues, while it detects the generation of the specific chord in the predetermined period to thereby determine the key by each major or minor key when the rhythm kind designates the blues. In other words, the key determining method concerning the major and minor keys is varied in response to the two tune kinds only. However, it is possible to further classify this key determining method. More specifically, it is possible to determine the key by detecting the generation of the different specific chord progression or different specific chord by each rhythm kind which is designated by the rhythm selecting switches 31.

(5) The present embodiment employs the keyboard 10. Instead of this keyboard 10, it is possible to provide the input interface unit which inputs the note name information corresponding to the key to be depressed. This input interface unit sequentially inputs the plural note name information for designating the chord which is supplied from another electronic musical instrument or another keyboard unit. Then, in step 102 shown in FIG. 5A, it is judged whether or not the input interface unit inputs the note name information. In step 104, the fetching of the note name information from the input interface unit is to be controlled. Thus, by inputting the key-depression information (i.e., note name information) from another electronic musical instrument or another keyboard unit, it is possible to generate the desirable accompaniment tone.

Finally, this invention may be practiced or embodied in still other ways without departing from the spirit or essential character thereof as described heretofore. Therefore, the preferred embodiment described herein is illustrative and not restrictive, the scope of the invention being indicated by the appended claims and all variations which come within the meaning of the claims are intended to be embraced therein.

What is claimed is:

1. An electronic musical instrument having an automatic tonality designating function comprising:

(a) chord designating means for designating a chord;

(b) chord information storing means having plural storing areas which can store plural chord information in a period of time, said chord information storing means replacing the oldest chord information stored therein with another new chord information indicative of the chord which is newly designated by said chord designating means;

(c) judging means for judging whether or not said chord information storing means stores all chord information indicative of plural specific chords each of which is predetermined for each key; and (d) tonality data setting means for automatically setting tonality data indicative of a tonality corresponding to said specific chord based on a judgement result of said judging means, whereby a desirable tonality is automatically designated by said tonality data.

2. An electronic musical instrument according to claim 1 wherein said judging means further comprises:

(a) flag data storing means having plural storing areas each corresponding to each specific chord of each key, said flag data storing means storing flag data indicative of whether or not said specific chord is stored in said chord information storing means by each of said storing areas thereof;

(b) writing control means for controlling an operation of writing said flag data into said flag data storing means based on said chord information stored in said chord information storing means when said chord designating means designates the chord; and (c) flag data checking means for checking said flag data concerning each specific chord of each key by referring to said flag data storing means.

3. An electronic musical instrument having an automatic key designating function comprising:

(a) note name information inputting means for inputting note name information indicative of a note name;

(b) chord detecting means for detecting a chord based on said note name information to be inputted;

(c) chord information storing means having plural storing areas which can store plural chord information indicative of the chord detected by said chord detecting means in a period of time, said chord information storing means replacing the oldest chord information stored therein with another new chord information indicative of the chord which is newly detected by said chord detecting means;

(d) judging means for judging whether or not said chord information storing means stores all chord information indicative of plural specific chords each of which is predetermined for each key; and (e) key data setting means for automatically setting key data indicative of a key corresponding to said specific chord based on a judgement result of said judging means, whereby a desirable key is automatically designated by said key data.

4. An electronic musical instrument according to claim 3 wherein said judging means further comprises:

(a) flag data storing means having plural storing areas each corresponding to each specific chord of each key, said flag data storing means storing flag data indicative of whether or not said specific chord is stored in said chord information storing means by each of said storing areas thereof;

(b) writing control means for controlling an operation of writing said flag data into said flag data storing means based on said chord information stored in said chord information storing means when said chord detecting means detects the chord; and (c) flag data checking means for checking said flag data concerning each specific chord of each key by referring to said flag data storing means.

5. An electronic musical instrument having an automatic key designating function comprising:

(a) rhythm designating means for designating a rhythm kind of a rhythm performance to be performed;

(b) chord designating means for designating a chord;

(c) chord information storing means for storing chord information indicative of the chord designated by said chord designating means; and (d) key designating means for automatically designating a desirable key in accordance with a predetermined condition corresponding to the rhythm kind designated by said rhythm designating means based on said chord information stored in said chord information storing means, wherein said predetermined condition is set by each of the rhythm kinds to be designated by said rhythm designating means.

6. An electronic musical instrument having an automatic key designating function comprising:

(a) rhythm designating means for designating a rhythm kind of a rhythm performance to be performed;

(b) note name information inputting means for inputting note name information indicative of a note name;

(c) chord detecting means for detecting a chord based on said note name information;

(d) chord information storing means for storing chord information indicative of the chord detected by said chord detecting means; and (e) key designating means for automatically designating a desirable key in accordance with a predetermined condition corresponding to the rhythm kind designated by said rhythm designating means based on said chord information stored in said chord information storing means, wherein said predetermined condition is set by each of the rhythm kinds to be designated by said rhythm designating means.

7. An electronic musical instrument according to claim 5 or 6 wherein said key designating means further comprises:

(a) first designating means for designating the key in response to a chord progression which is predetermined for each key; and (b) second designating means for designating the key in response to an emergence of a specific chord which is predetermined for each key.

8. An electronic musical instrument comprising:

(a) chord designating means for designating a chord;

(b) mode determining means for determining a mode in response to the chord designated by said chord designating means;

(c) rhythm designating means for designating a rhythm kind of a rhythm performance to be performed;

(d) accompaniment pattern generating means for generating pitch difference data in response to the mode determined by said mode determining means and the rhythm kind designated by said rhythm designating means, said pitch difference data indicating a pitch difference from a tone pitch of a base note which is preset for the mode, said pitch difference data being outputted in accordance with a rhythm progression;

(e) adding means for adding said pitch difference data with root data indicative of a root of the chord designated by said chord designating means to thereby obtain accompaniment tone data indicative of a tone pitch of an accompaniment tone to be performed; and (f) accompaniment tone signal generating means for generating an accompaniment tone signal having the tone pitch indicated by said accompaniment tone data, whereby an automatic accompaniment is performed in accordance with said accompaniment tone signal.

9. An electronic musical instrument according to claim 8 wherein said mode determining means further comprises:

(a) first means for determining a key based on a series of chords which are sequentially designated by said chord designating means; and (b) second means for finally designating a desirable key based on the key determined by said first means and the chord designated by said chord designating means.

10. An electronic musical instrument comprising:

(a) chord designating means for designating a chord;

(b) key designating means for designating a key;

(c) mode determining means for determining a mode in response to the chord designated by said chord designating means and the key designating by said key designating means;

(d) rhythm designating means for designating a rhythm kind of a rhythm performance to be performed;

(e) accompaniment pattern generating means for generating pitch difference data in response to the mode determined by said mode determining means and the rhythm kind designated by said rhythm designating means, said pitch difference data indicating a pitch difference from a tone pitch of a base note which is preset for the mode, said pitch difference data being outputted in accordance with a rhythm progression;

(f) adding means for adding said pitch difference data with root data indicative of a root of the chord designated by said chord designating means to thereby obtain accompaniment tone data indicative of a tone pitch of an accompaniment tone to be performed; and (g) accompaniment tone signal generating means for generating an accompaniment tone signal having the tone pitch indicated by said accompaniment tone data, whereby an automatic accompaniment is performed in accordance with said accompaniment tone signal.

11. An electronic musical instrument according to claim 8 or 10 wherein said accompaniment pattern generating means further comprises:

(a) an accompaniment pattern memory for storing said pitch difference data by each rhythm kind and by each mode; and (b) reading means for sequentially reading said pitch difference data from said accompaniment pattern memory in accordance with the rhythm progression in response to the rhythm kind designated by said rhythm designating means and the mode determined by said mode determining means.

12. An electronic musical instrument according to claim 8 or 10 wherein said accompaniment pattern generating means further comprises:

(a) an accompaniment pattern memory for storing degree data indicative of a degree of the pitch difference from the base note of each mode by each rhythm kind, said degree data being used in common in each mode;

(b) reading means for sequentially reading said degree data from said accompaniment pattern memory in accordance with the rhythm progression in response to the rhythm kind designated by said rhythm designating means; and (c) converting means for converting said degree data read by said reading means into said pitch difference data indicative of said pitch difference from the base note of the mode designated by said mode determining means.

13. In an electronic musical instrument which inputs plural note name information each indicative of each of note names within a scale so that a chord is to be detected in response to a combination of said plural note name information, said electronic musical instrument comprising:

(a) chord storing means for storing chord information indicative of the chord to be detected;

(b) chord extracting means for extracting plural chords each having a root whose note name is designated in response to the combination of said plural note name information to be inputted; and (c) chord designating means for newly designating a desirable chord among the plural chords extracted by said chord extracting means, wherein said desirable chord has a predetermined chord progression relation to a precedingly designated chord indicated by said chord information stored in said chord storing means, said chord designating means writing new chord information indicative of said desirable chord into said chord storing means.

14. In an electronic musical instrument which inputs plural note name information each indicative of each of note names within a scale so that a chord is to be detected in response to a combination of said plural note name information, said electronic musical instrument comprising:

(a) chord storing means for storing chord information indicative of the chord to be detected;

(b) key designating means for designating a key;

(c) chord extracting means for extracting plural chords each having a root whose note name is designated in response to the combination of said plural note name information to be inputted; and (d) chord designating means for newly designating a desirable chord among the plural chords extracted by said chord extracting means based on the key designated by said key designating means and a precedingly designated chord indicated by said chord information stored in said chord storing means, wherein said desirable chord has a predetermined chord progression relation to the precedingly designated chord in the designated key, said chord designating means writing new chord information indicative of said desirable chord into said chord storing means.

15. In an electronic musical instrument which inputs plural note name information each indicative of each of note names within a scale so that a chord is to be detected in response to a combination of said plural note name information, said electronic musical instrument comprising:

(a) key designating means for designating a key;

(b) chord extracting means for extracting plural chords each having a root whose note name is designated in response to the combination of said plural note name information to be inputted; and (c) chord designating means for designating a specific chord in the key designated by said key designating means among the plural chords extracted by said chord extracting means, said specific chord being used as a detected chord.

16. In an electronic musical instrument which inputs plural note name information each indicative of each of note names within a scale so that a chord is to be detected in response to a combination of said plural note name information, said electronic musical instrument comprising:

(a) chord storing means for storing chord information indicative of the chord to be detected;

(b) key designating means for designating a key;

(c) chord extracting means for extracting plural chords each having a root whose note name is designated in response to the combination of said plural note name information to be inputted; and (d) chord designating means for newly designating a desirable chord among the plural chords extracted by said chord extracting means wherein each chord has its own tension degree which is determined in response to the key designated by said key designating means, wherein said tension degree of said desirable chord has a predetermined relation to a tension degree of a precedingly designated chord indicated by said chord information stored in said chord storing means, said chord designating means writing new chord information indicative of said desirable chord into said chord storing means.

17. An electronic musical instrument according to any one of claims 13 to 16 wherein said chord extracting means further comprises:

(a) root setting means for setting each of the plural note names as the root; and (b) judging means for judging whether or not the plural note names includes a specific note name having a degree which has a predetermined relation to each of the roots set by said root setting means.

18. An electronic musical instrument according to claim 17 wherein said specific note name corresponds to a basic constituent note of the chord which is predetermined for each chord.

19. An electronic musical instrument according to any one of claims 14, 15 and 16 wherein said key designating means automatically designates a desirable key in response to the detected chord.

20. An electronic musical instrument according to any one of claims 14, 15 and 16 wherein said key designating means is configured by a key designating switch by which a desirable key is designated by a performer.

21. In an electronic musical instrument which detects a chord based on a combination of plural note name information each indicative of each of plural note names within a scale, said electronic musical instrument comprising:

(a) chord extracting means for extracting plural chords each having a root which corresponds to each of said plural note names designated by said plural note name information to be inputted; and (b) chord selecting means for selecting a desirable chord among said plural chords extracted by said chord extracting means wherein each of said plural chords relates to its own tension note whose note name is included in said plural note names, said desirable chord having the tension note concerning a tension degree which is the smallest among all tension notes relating to said plural chords.

22. An electronic musical instrument according to claim 21 wherein said chord extracting means further comprises:

(a) root setting means for setting each of said plural note names as a root; and (b) judging means for judging whether or not said plural note names includes a specific note name which has a predetermined degree relation to each root set by said root setting means.

23. An electronic musical instrument according to claim 22 wherein said specific note name is one of basic constituent notes of the chord and said specific note name is predetermined by each chord.

24. An electronic musical instrument according to claim 21, wherein said chord selecting means selects one of the chords extracted from said chord extracting means as said desirable chord having the tension note concerning the tension degree which is the smallest among the tension degrees of all tension notes relating to said plural chords, said one of the chords to be selected having the tension notes whose number is the smallest among numbers of tension notes of said plural chords.

25. An electronic musical instrument according to claim 21 or 24 wherein said tension note is predetermined for each chord.

26. An electronic musical instrument according to claim 21 wherein plural tension degrees are set for said plural chords extracted by said chord extracting means, said chord selecting means selecting one of said plural chords including the tension note whose tension degree is the smallest among said plural tension degrees as said desirable chord.

27. An electronic musical instrument according to claim 26, wherein said tension note is predetermined for each chord, while said tension degree of each tension note is expressed by a number and is predetermined for each chord.

28. An electronic musical instrument having an automatic key designating function comprising:

(a) chord designating means for designating a chord;

(b) chord information storing means for storing chord information indicative of the chord designated by said chord designating means;

(c) chord progression detecting means for detecting a predetermined specific chord progression in response to a preceding chord and a current chord at least, wherein said preceding chord is indicated by said chord information stored in said chord information storing means and said current chord is newly designated by said chord designating means; and (d) key data setting means for setting key data indicative of a key corresponding to said specific chord progression detected by said chord progression detecting means, whereby a desirable key is automatically designated by said key data.

29. An electronic musical instrument having an automatic key designating function, comprising:

(a) chord designating means for designating a chord;

(b) chord information storing means having plural storing areas each capable of storing chord information in a period of time, wherein old chord information indicative of the oldest chord among plural chords stored in said plural storing areas is replaced by new chord information indicative of the chord newly designated by said chord designating means;

(c) chord progression detecting means for detecting predetermined specific chord progression in response to a preceding chord and a current chord at least, wherein said preceding chord is indicted by said chord information stored in said chord information storing means and said current chord is newly designated by said chord designating means;

(d) means for determining plural temporary keys based on said specific chord progression detected by said chord progression detecting means and said plural chord information stored in said chord information storing means, said means then examining a harmonic degree between each of said temporary keys and each of said plural chords indicated by said plural chord information; and (e) key data setting means for setting key data indicative of said temporary key whose harmonic degree is the highest, whereby a desirable key is automatically designated by said key data.

30. An electronic musical instrument having an automatic key designating function comprising:

(a) plural performance members each corresponding to each of plural note names included in a scale;

(b) chord detecting means for detecting a chord in response to a combination of said performance members to be simultaneously operated;

(c) chord information storing means for storing chord information indicative of the chord detected by said chord detecting means;

(d) note name information storing means providing plural storing areas each capable of storing note name information indicative of said note name, said note name information storing means capable of storing plural groups of simultaneously operated note name information, each group of simultaneously operated note name information indicating simultaneously operated note names corresponding to said performance members to be simultaneously operated, said note name information storing means replacing the oldest group of simultaneously operated note name information with the newest group of simultaneously operated note name information;

(e) chord progression detecting means for detecting a predetermined specific chord progression in response to a preceding chord and a current chord, wherein said preceding chord is indicated by said chord information stored in said chord information storing means and said current chord is newly designated by said chord detecting means;

(f) means for determing plural temporary keys based on said specific chord progression detected by said chord progression detecting means and said note name information stored in said note name information storing means, said means then examining whether said note name information storing means stores said note name information concerning said note name adequate to or inadequate to said temporary key; and (g) key data setting means for setting key data key data indicative of one of said temporary keys which is selected based on an examination result of said means for determining, whereby a desirable key is automatically designated by said key data.

31. An electronic musical instrument having an automatic key designating function comprising:

(a) input means for inputting note name information indicative of a note name;

(b) chord detecting means for detecting a chord based on said note name information input by said inputting means;

(c) chord information storing means for storing chord information indicative of the chord detected by said chord detecting means;

(d) chord progression detecting means for detecting a predetermined specific chord progression in response to a preceding chord and a current chord at least, wherein said preceding chord being indicated by said chord information stored in said chord information storing means and said current chord is newly designated by said chord detecting means; and (e) key data setting means for setting key data indicative of a key corresponding to said specific chord progression detected by said chord progression detecting means, whereby a desirable key is automatically designated by said key data.

32. An electronic musical instrument having an automatic key designating function comprising:

(a) chord designating means for designating a chord;

(b) temporary key determining means for determining a temporary key corresponding to said chord designated by said chord designating means;

(c) first storing means providing plural storing areas capable of storing data indicative of times of determining said temporary key by each key;

(d) incrementing means for incrementing said data stored in said storing means every time said temporary key determining means determines said temporary key;

(e) second storing means for storing key data indicative of a finally determined key; and (f) changing means for changing said key data stored in said second storing means based on a result of comparing said times of determining said temporary key with another times of determining said finally determined key, whereby a desirable key is automatically designated by said key data.

33. An electronic musical instrument having an automatic tonality determining function comprising:

(a) musical style designating means for designating a musical style of a music to be performed;

(b) chord designating means for designating a chord;

(c) chord information storing means for storing chord information indicative of the chord designated by said chord designating means; and (d) tonality determining means for automatically determining a desirable tonality in accordance with a predetermined condition corresponding to said musical style designated by said musical style designating means based on said chord information stored in said chord information storing means, wherein said predetermine condition is set by each of musical styles in advance.

34. An electronic musical instrument comprising:

(a) chord designating means for designating a chord;

(b) mode determining means for determining a mode in response to the chord designated by said chord designating means;

(c) musical style designating means for designating a musical style of a music to be performed;

(d) accompaniment pattern generating means for generating pitch difference data in response to the mode determined by said mode determining means and said musical style designated by said musical style designating means, said pitch difference data indicating a pitch difference from a tone pitch of a base note which is preset for the mode, said pitch difference data being outputted in accordance with a music progression;

(e) adding means for adding said pitch difference data with root data indicative of a root of the chord designated by said chord designating means to thereby obtain accompaniment tone data indicative of a tone pitch of an accompaniment tone to be performed; and (f) accompaniment tone signal generating means for generating an accompaniment tone signal having the tone pitch indicated by said accompaniment tone data, whereby an automatic accompaniment is performed in accordance with said accompaniment tone signal.

35. An electronic musical instrument as defined in claim 33 or 34, wherein said musical style indicates a rhythm kind.

* * * * *